US007864139B2

(12) United States Patent
Hara

(10) Patent No.: US 7,864,139 B2
(45) Date of Patent: Jan. 4, 2011

(54) ORGANIC EL DEVICE, DRIVING METHOD THEREOF, AND ELECTRONIC APPARATUS

(75) Inventor: Hiroyuki Hara, Chino (JP)

(73) Assignee: Seiko Epson Corporation, Tokyo (JP)

( * ) Notice: Subject to any disclaimer, the term of this patent is extended or adjusted under 35 U.S.C. 154(b) by 995 days.

(21) Appl. No.: 11/354,031

(22) Filed: Feb. 15, 2006

(65) Prior Publication Data

US 2006/0208656 A1 Sep. 21, 2006

(30) Foreign Application Priority Data

Mar. 18, 2005 (JP) ..... 2005-079618

(51) Int. Cl.
*G09G 3/30* (2006.01)

(52) U.S. Cl. ..... 345/76; 345/77; 345/204; 345/212; 257/294

(58) Field of Classification Search ..... 345/55, 345/76, 77, 204, 212, 214; 257/294
See application file for complete search history.

(56) References Cited

U.S. PATENT DOCUMENTS

| | | | | |
|---|---|---|---|---|
| 6,839,057 | B2 * | 1/2005 | Iguchi | 345/204 |
| 7,046,240 | B2 * | 5/2006 | Kimura | 345/212 |
| 7,250,931 | B2 | 7/2007 | Tanada et al. | |
| 7,259,735 | B2 | 8/2007 | Kasai | |
| 7,411,586 | B2 * | 8/2008 | Kimura | 345/214 |
| 7,486,100 | B2 | 2/2009 | Sakaguchi et al. | |
| 2003/0001828 | A1 * | 1/2003 | Asano | 345/204 |
| 2003/0016189 | A1 * | 1/2003 | Abe et al. | 345/55 |
| 2003/0142509 | A1 | 7/2003 | Tsuchiya et al. | |
| 2004/0095299 | A1 * | 5/2004 | Matsumoto | 345/76 |
| 2004/0104870 | A1 | 6/2004 | Mametsuka | |
| 2005/0051817 | A1 * | 3/2005 | Morita et al. | 257/294 |
| 2005/0068273 | A1 * | 3/2005 | Suzuki | 345/77 |
| 2005/0140604 | A1 * | 6/2005 | Shin | 345/76 |
| 2007/0257867 | A1 | 11/2007 | Kasai | |
| 2007/0257868 | A1 | 11/2007 | Kasai | |
| 2007/0268286 | A1 | 11/2007 | Tanada et al. | |

FOREIGN PATENT DOCUMENTS

| | | | |
|---|---|---|---|
| JP | 10039791 A | * | 2/1998 |
| JP | A-10-039791 | | 2/1998 |
| JP | A 2003-255899 | | 9/2003 |
| JP | A 2003-271100 | | 9/2003 |
| JP | A-2004-170787 | | 6/2004 |
| JP | A-2004-191752 | | 7/2004 |
| JP | A-2004-294850 | | 10/2004 |
| WO | WO 2004/066249 A1 | | 8/2004 |
| WO | WO 2004/100110 A1 | | 11/2004 |

* cited by examiner

*Primary Examiner*—Amare Mengistu
*Assistant Examiner*—Premal Patel
(74) *Attorney, Agent, or Firm*—Oliff & Berridge, PLC

(57) ABSTRACT

An organic electroluminescent device including: a plurality of pixels, each having a red light emitting element to emit red light, a green light emitting element to emit green light, and a blue light emitting element to emit blue light; and a drive device adjusting a luminance ratio among the red light, the green light, and the blue light by adjusting light emitting time of each of the red light emitting element, the green light emitting element, and the blue light emitting element.

9 Claims, 12 Drawing Sheets

ORGANIC EL DEVICE, DRIVING METHOD THEREOF, AND ELECTRONIC APPARATUS

BACKGROUND

1. Technical Field

The present invention relates to an organic electroluminescent (hereinafter, referred to as organic EL) device, a driving method thereof and an electronic apparatus.

2. Related Art

An organic EL device having an organic EL element as a self light emitting element that requires no backlight has been drawing attention recently. The organic EL element is composed of an organic EL layer, i.e. a light emitting element, disposed between a pair of electrodes opposed to each other. An organic EL device, on which a full-color display appears, is composed of the light emitting elements, each having a light emitting wave length region that corresponds to respective colors of red (R), green (G), and blue (B). When a voltage is applied between the pair of electrodes opposed to each other, injected electrons and holes are re-bonded in the light emitting element, thereby the light emitting element emits light. The light emitting element included in such organic EL device is typically formed of a thin film having a thickness of less than 1 μm. In addition, the organic EL device needs no backlights used in conventional liquid crystal display devices since the light emitting element emits light. Therefore, the organic EL device has an advantage in that it can be made extremely thin.

In the organic EL device, when white and any colors are displayed by combining light emitted from light emitting elements each of which emits respective colors of red (R), green (G), and blue (B), each light needs to be balanced in luminance in order to achieve white at an targeted coordinate point in the international commission on illumination (CIE) standard coordinate system. As a typical way to take the luminance balance, a method is exemplified in which a different voltage is applied to respective light emitting elements each of which emits red (R), green (G), and blue (B) for adjusting the luminance.

However, adjusting the light emission luminance of the light emitting elements each of which emits red (R), green (G), and blue (B) by applying a voltage causes a different injection current in each light emitting element depending on colors. Here, the light emission lifetime of the organic EL element largely depends on the injection current. Thus, the different injection current in the light emitting elements each of which emits the respective colors causes a different speed in luminance deterioration depending on colors, thereby resulting in the white balance being lowered with time. In order to solve the problems described above, a technique is disclosed in JP-A-10-39791. In the technique, the white balance is achieved by differentiating a light emitting area while the same voltage is applied to light-emitting elements each of which emits respective colors.

The use of the technique disclosed in JP-A-10-39791 allows the luminance balance of each color to be maintained for longer period as compared with the conventional one. The technique, however, has a drawback in that a difference in individual organic EL devices cannot be adjusted. In addition, it cannot cope with changes in light emitting characteristics with time, i.e. deterioration with time.

SUMMARY

An advantage of the present invention is to provide an organic EL device that is capable of adjusting the variation in a white balance attributed to the light emission luminance property of an organic EL element as well as preventing the change with time of the white balance, a driving method thereof and an electronic apparatus including the organic EL device.

An organic EL device according to a first aspect of the invention includes a plurality of pixels, each having a red light emitting element to emit red light, a green light emitting element to emit green light, a blue light emitting element to emit blue light, and a drive device adjusting a luminance ratio among the red light, the green light, and the blue light by adjusting light emitting time of each of the red light emitting element, the green light emitting element, and the blue light emitting element.

In this case, a predetermined luminance ratio among the red light, green light, and blue light can be achieved even if the red light emitting element, green light emitting element, and blue light emitting element have a difference in characteristics since the luminance ratio among the red light, green light, and blue light is adjusted by adjusting the light emitting time of each of the red light emitting element, green light emitting element, and blue light emitting element. In addition, the same voltage is applied to each of the red light emitting element, green light emitting element, and blue light emitting element since the luminance ratio among the red light, green light, and blue light is adjusted by adjusting the light emitting time of each of the red light emitting element, green light emitting element, and blue light emitting element. As a result, the deterioration speed of luminance of each light emitting element can be made nearly equal.

In the organic EL device according to the first aspect of the invention, the drive device preferably adjusts the luminance ratio among the red light, green light, and blue light so as to achieve a predetermined white balance.

In the organic EL device according to the first aspect of the invention, the drive device renders each of the red light emitting element, green light emitting element, and blue light emitting element to emit light at the same light emission start timing, and individually sets a non-light emission start timing to render each of the red light emitting element, green light emitting element, and blue light emitting element to be a non-light emission state so as to adjust the luminance ratio among the red light, green light, and blue light.

In this case, the red light, green light, and blue light can be achieved with the predetermined luminance ratio among them without complicating the drive of each of the red light emitting element, green light emitting element, and blue light emitting element since each of the red light emitting element, green light emitting element, and blue light emitting element are rendered to emit light at the same light emission start timing, and to be the non-light emission state at the non-light emission start timing individually set among them.

The organic EL device according to the first aspect of the invention further includes: a plurality of write scan lines provided for a unit composed of a predetermined number of pixels among the plurality of pixels; a plurality of erase scan lines, each being provided to each of the red light emitting element, green light emitting element, and blue light emitting element that are included in each of the predetermined number of pixels, and the plurality of erase scan lines being provided corresponding to the plurality of write scan lines; and a plurality of data lines, each being provided to each of the red light emitting element, green light emitting element, and blue light emitting element that are included in each of the predetermined number of pixels, the plurality of data lines extending in a direction perpendicular to the plurality of write scan lines and erase scan lines, wherein the drive device renders each of the red light emitting element, green light emitting element, and blue light emitting element that are provided in each of the predetermined number of pixels to emit light via the plurality of write scan lines, and renders each of the red light emitting element, green light emitting element, and blue light emitting element that are provided in each of the predetermined number of pixels to be the non-light emission state via the plurality of erase scan lines.

In the organic EL device according to the first aspect of the invention, the drive device divides one frame into a plurality of sub-frames depending on the number of grayscales represented by an image signal supplied to the plurality of data lines, and controls one of a light emission state and the non-light emission state of each of the red light emitting element, green light emitting element, and blue light emitting element in each of the plurality of sub-frames.

In this case, the red light, green light, and blue light can be achieved with the predetermined luminance ratio among them even if the image signal supplied to the data lines is a digital signal since each of the red light emitting element, green light emitting element, and blue light emitting element is controlled to be the light emission state or to be the non-light emission state in each of the plurality of sub-frames divided from one frame.

In the organic EL device according to the first aspect of the invention, the drive device preferably controls the light emitting time of each of the red light emitting element, green light emitting element, and blue light emitting element in the plurality of sub-frames so as to be a predetermined time ratio.

In the organic EL device according to the first aspect of the invention, each of the predetermined number of pixels further includes: a drive element driving each of the red light emitting element, green light emitting element, and blue light emitting element based on a signal from the plurality of write scan lines and a signal from the plurality of data lines; and a memory element storing a characteristic of the drive element.

In this case, the characteristic of the drive element driving each of the red light emitting element, green light emitting element, and blue light emitting element is stored in the memory element in each of the predetermined number of pixels.

The organic EL device according to the first aspect of the invention further includes a first control line controlling whether the characteristic of the drive element is stored in the memory element or not, the first control line being provided corresponding to the plurality of write scan lines.

In this case, whether the characteristic of the drive element is stored in the memory element or not can be controlled via the first control line.

The organic EL device according to the first aspect of the invention further includes a second control line controlling whether each of the red light emitting element, green light emitting element, and blue light emitting element is driven or not by using the drive element having a characteristic compensated based on a content stored in the memory element, the second control line being provided corresponding to the plurality of write scan lines.

In this case, whether each of the red light emitting element, green light emitting element, and blue light emitting element is driven or not can be controlled by using the drive element having the compensated characteristic via the second control line.

In the organic EL device according to the first aspect of the invention, the drive device compensates a luminance change with time of each of the red light emitted from the red light emitting element, the green light emitted from the green light emitting element, and the blue light emitted from the blue light emitting element.

In this case, the change with time in a white balance can be prevented since the luminance change with time of the light emitted from each light emitting element is compensated.

A method for driving an organic EL device that includes a plurality of pixels, each having a red light emitting element to emit red light, a green light emitting element to emit green light, and a blue light emitting element to emit blue light according to a second aspect of the invention includes adjusting a luminance ratio among the red light, the green light, and the blue light by adjusting light emitting time of each of the red light emitting element, the green light emitting element, and the blue light emitting element.

In this case, a predetermined luminance ratio among the red light, green light, and blue light can be achieved even if the red light emitting element, green light emitting element, and blue light emitting element have a difference in characteristics since the luminance ratio among the red light, green light, and blue light is adjusted by adjusting the light emitting time of each of the red light emitting element, green light emitting element, and blue light emitting element. In addition, the same voltage is applied to each of the red light emitting element, green light emitting element, and blue light emitting element since the luminance ratio among the red light, green light, and blue light is adjusted by adjusting the light emitting time of each of the red light emitting element, green light emitting element, and blue light emitting element. As a result, the deterioration speed of luminance of each light emitting element can be made nearly equal.

The method for driving an organic EL device according to the second aspect of the invention preferably adjusts the luminance ratio among the red light, green light, and blue light so as to achieve a predetermined white balance.

The method for driving an organic EL device according to the second aspect of the invention renders each of the red light emitting element, green light emitting element, and blue light emitting element to emit light at the same light emission start timing, and individually sets a non-light emission start timing to render each of the red light emitting element, green light emitting element, and blue light emitting element that are provided in the pixel to be a non-light emission state so as to adjust the luminance ratio among the red light, green light, and blue light.

In this case, the red light, green light, and blue light can be achieved with the predetermined luminance ratio among them without complicating the drive of each of the red light emitting element, green light emitting element, and blue light emitting element since each of the red light emitting element, green light emitting element, and blue light emitting element are rendered to emit light at the same light emitting start timing, and to be the non-light emission state at a non-light emission start timing individually set among them.

An electronic apparatus according to a third aspect of the invention includes any of the organic EL devices described above.

This structure can provide an electronic apparatus having a good display characteristic.

BRIEF DESCRIPTION OF THE DRAWINGS

The invention will be described with reference to the accompanying drawings, wherein like numbers refer to like elements, and wherein.

DESCRIPTION OF EXEMPLARY EMBODIMENTS

An organic EL device, a driving method thereof and an electronic apparatus according to embodiments of the invention will be described referring to the accompanying drawings. The embodiments of the invention are shown by way of example, and not intended to limit the invention. It is understood that various modifications can be made without departing from the spirit and scope of the invention. Note that the scale of each layer and member is adequately changed in the accompanying drawings, so that they are visible.

First Embodiment

Figure 1:
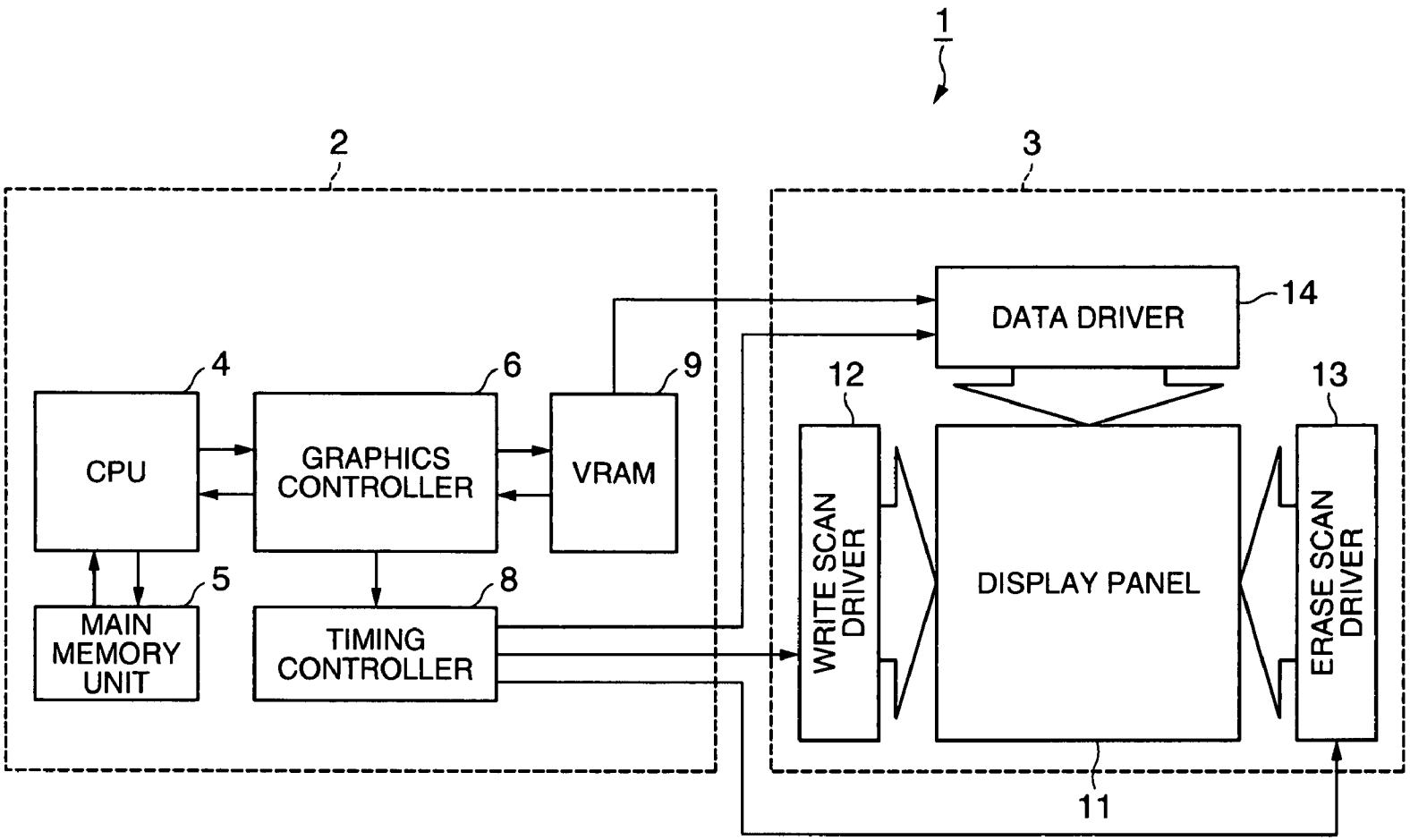
FIG. 1 is a block diagram illustrating the electrical structure of an organic EL device according to a first embodiment of the invention.

FIG. 1 is a block diagram illustrating the electrical structure of an organic EL device according to a first embodiment of the invention. An organic EL device 1 of the embodiment adopts a time division grayscale scheme that divides a frame into four sub-frames with different time ratios and adequately selects a sub-frame to emit light to represent a halftone.

As shown in FIG. 1, the organic EL device 1 includes a peripheral drive device 2 and a display panel unit 3. The peripheral drive device 2 includes a central processing unit (CPU) 4, a main memory unit 5, a graphics controller 6, a timing controller 8 and a video RAM (VRAM) 9. The CPU 4 may be replaced with a microprocessor unit (MPU). The display panel unit 3 includes a display panel 11, a write scan driver 12, an erase scan driver 13, and a data driver 14.

The CPU included in the peripheral drive device 2 reads image data stored in the main memory unit 5, carries out various types of processing, such as expansion process, with the main memory unit 5, and outputs processed data to the graphics controller 6. The graphics controller 6 produces image data based on the image data output from the CPU 4 and generates synchronizing signals (vertical synchronizing signal and horizontal synchronizing signal), both of which are for the display panel unit 3. The graphics controller 6 transfers the produced image data to the VRAM 9 and outputs the generated synchronizing signals to the timing controller 8.

The VRAM 9 outputs the image data output from the graphics controller 6 to the data driver 14 included in the display panel unit 3, while the timing controller 8 outputs the horizontal synchronizing signal to the data driver 14 included in the display panel unit 3 and the vertical synchronizing signal to the write scan driver 12 included in the display panel unit 3. In addition, the timing controller 8 outputs an erase scan signal to the erase scan driver 13 included in the display panel 11, the erase scan signal rendering the organic EL element disposed in the display panel 11 to be a non-light emission state. The image data from the VRAM 9 and the various signals from the timing controller 8 are synchronized and output to the display panel 11.

Display Panel Unit 3

Figure 2:
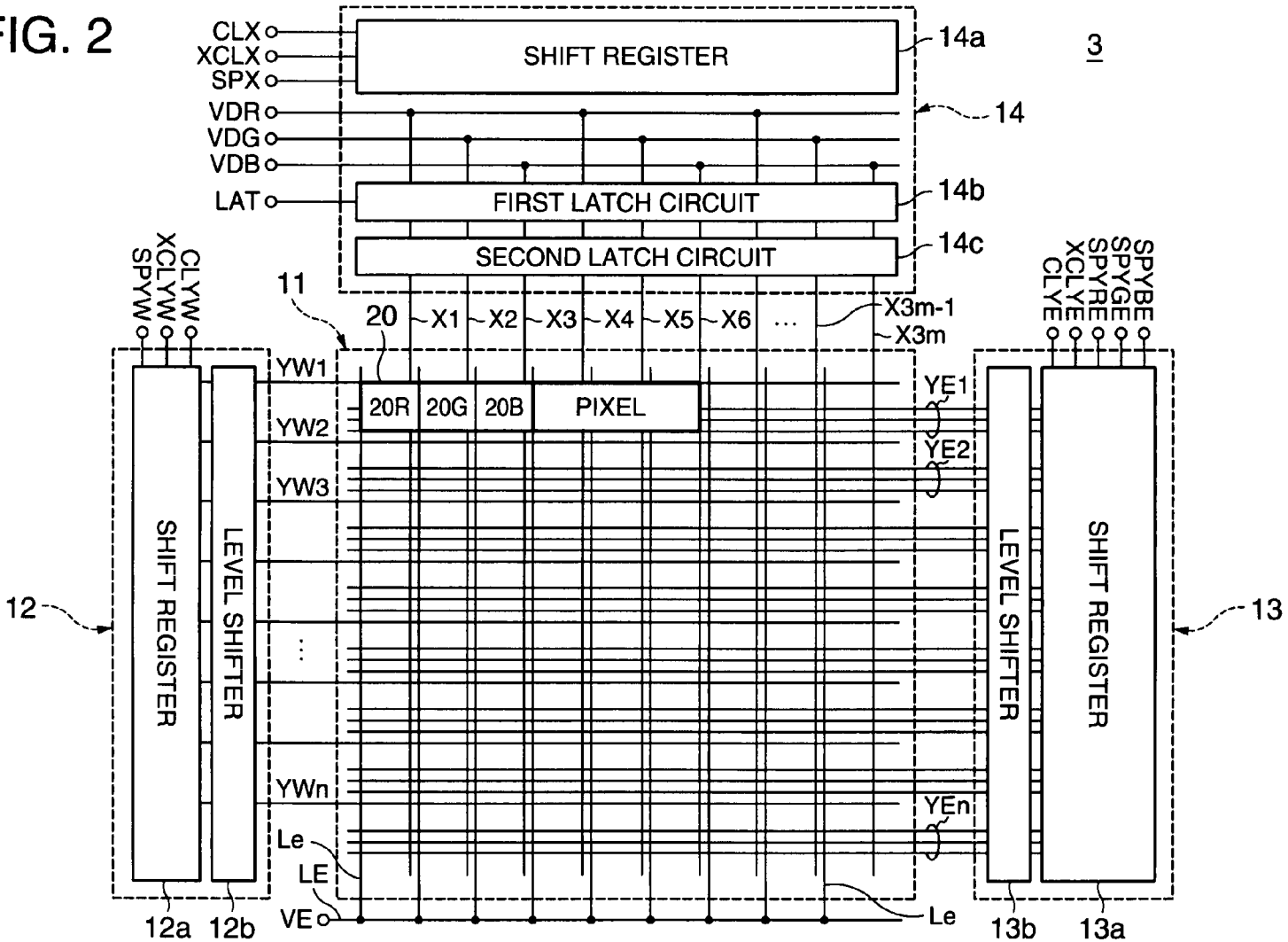
FIG. 2 is a block diagram illustrating the structure of a display panel unit included in the organic EL device according to the first embodiment of the invention.

FIG. 2 is a block diagram illustrating the structure of the display panel unit included in the organic EL device according to the first embodiment of the invention. As shown in FIG. 2, the display panel 11 included in the display panel unit 3 includes n number of write scan lines YW1 to YWn (n is a natural number) extending in the row direction, and 3n number of erase scan lines YE1 to YEn extending in the row direction. Here, the erase scan line YE1, for example, includes a scan line YE1R for erasing red, a scan line YE1G for erasing green, and a scan line YE1B for erasing blue, while the erase scan line YEn includes a scan line YEnR for erasing red, a scan line YEnG for erasing green, and a scan line YEnB for erasing blue. Other erase scan lines YE2 to YEn−1 are followed in the same manner.

In addition, the display panel 11 includes 3m number of data lines X1 to X3*m* (m is a natural number) extending in the column direction perpendicular to the row direction. The display panel 11 also includes a plurality of pixels 20, each of which corresponds to each of the intersections of the write scan lines YW1 to YWn (erase scan lines YE1 to YEn) and the data lines X1 to X3*m*. That is, each of pixels 20R, 20G, and 20B is formed in a matrix by being allocated and electrically connected at each of intersections of the write scan lines YW1 to YWn (erase scan lines YE1 to YEn) extending in the row direction and the data lines X1 to X3*m* extending in the column direction.

Figure 3:
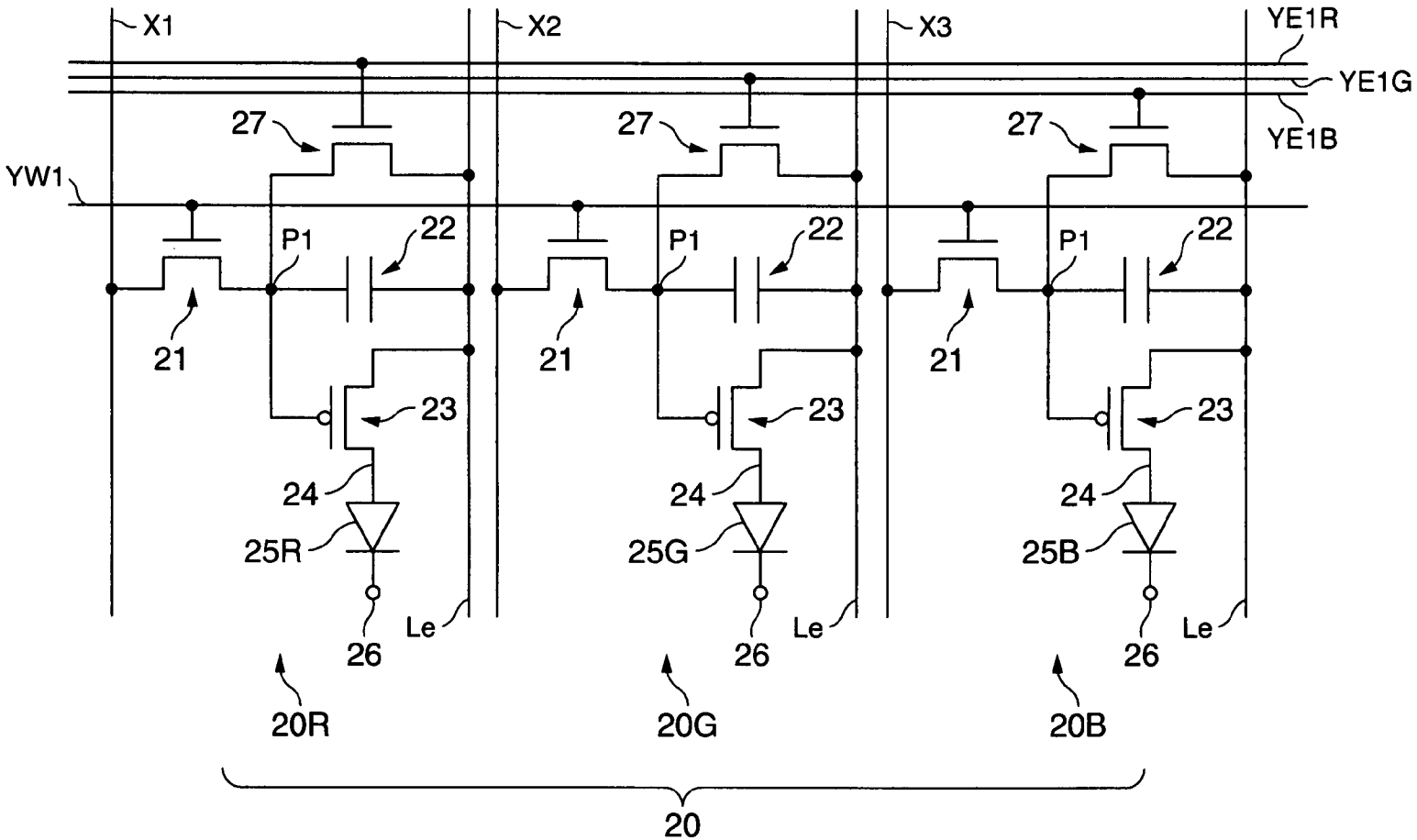
FIG. 3 is a circuit diagram illustrating the structure of a pixel 20 located at the upper left corner of the display panel included in the organic EL device according to the first embodiment of the invention.

FIG. 3 is a circuit diagram illustrating the structure of the pixel 20 located at the upper left corner of the display panel included in the organic EL device according to the first embodiment of the invention. As shown in FIG. 3, the pixel 20 located at the upper left corner of the display panel 11 includes the pixel 20R emitting red light, the pixel 20G emitting green light, and the pixel 20B emitting blue light. In this regard, other pixels 20 provided on the display panel 11 also have the structure composed of the pixels 20R, 20G, and 20B, which will be described below.

The pixel 20R includes a switching TFT 21 to which a write scan signal is supplied at its gate electrode via the write scan line YW1, a storage capacitor 22 for retaining a pixel signal supplied from the data line X1 via the switching TFT 21, a drive TFT 23 to which the pixel signal retained by the storage capacitor 22 is supplied at its gate electrode, a pixel electrode (electrode) 24 to which a driving current flows from a power supply line Le when the drive TFT 23 is electrically connected to the power supply line Le, and an organic EL element 25 R sandwiched between the pixel electrode 24 and a common electrode 26. In addition, a switching TFT 27 is provided to which an erase scan signal is supplied at its gate electrode via the erase scan line YE1R. The source electrode of the switching TFT is connected to the power supply line Le, while the drain electrode thereof is connected to the connection point P at which the switching TFT 21, the storage capacitor 22, and the drive TFT 23 are connected.

The pixel 20G includes the switching TFT 21 to which a write scan signal is supplied at its gate electrode via the write scan line YW1, the storage capacitor 22 for retaining a pixel signal supplied from the data line X2 via the switching TFT 21, the drive TFT 23 to which the pixel signal retained by the storage capacitor 22 is supplied at its gate electrode, the pixel electrode (electrode) 24 to which a driving current flows from the power supply line Le when the drive TFT 23 is electrically connected to the power supply line Le, and an organic EL element 25 G sandwiched between the pixel electrode 24 and the common electrode 26. In addition, the switching TFT 27 is provided to which an erase scan signal is supplied at its gate electrode via the erase scan line YE1G. The source electrode of the switching TFT is connected to the power supply line Le, while the drain electrode thereof is connected to the connection point P at which the switching TFT 21, the storage capacitor 22, and the drive TFT 23 are connected.

Likewise, the pixel 20B includes the switching TFT 21 to which a write scan signal is supplied at its gate electrode via the write scan line YW1, the storage capacitor 22 for retaining a pixel signal supplied from the data line X3 via the switching TFT 21, the drive TFT 23 to which the pixel signal retained by the storage capacitor 22 is supplied at its gate electrode, the pixel electrode (electrode) 24 to which a driving current flows from the power supply line Le when the drive TFT 23 is electrically connected to the power supply line Le, and an organic EL element 25 B sandwiched between the pixel electrode 24 and the common electrode 26. In addition, the switching TFT 27 is provided to which an erase scan signal is supplied at its gate electrode via the erase scan line YE1B. The source electrode of the switching TFT is connected to the power supply line Le, while the drain electrode thereof is connected to the connection point P at which the switching TFT 21, the storage capacitor 22, and the drive TFT 23 are connected.

In the pixel 20 structured as described above, when the write scan line YW1 is activated so as to turn on the switching TFT 21, each electric potential of data lines X1 to X3 at the time is stored in the storage capacitance 22 of each of the pixels 20R, 20G, and 20B. The on/off state of each drive TFT 23 provided in the pixels 20R, 20G, and 20B depends on the condition of each storage capacitor 22. Then, a current flows to each of pixel elements 20R, 20G, and 20B from each power supply line Le via the channel of each drive TFT 23, flowing to the common electrode 26 via each of the organic EL elements 25R, 25G, and 25B. As a result, each of the organic EL elements 25R, 25G, and 25B emits light depending on the current flow in it.

When the erase scan line YE1R is activated so as to turn on the switching TFT 27 provided in the pixel 20R while the write scan line YW1 is not activated, the electric potential of the connection point P1 in the pixel 20R becomes equal to that of the power supply line Le, resulting in the difference in the electric potential across the storage capacitance 22 being zero, and the drive TFT 23 to being turned off if it is on. When the erase scan line YE1G is activated so as to turn on the switching TFT 27 provided in the pixel 20G, the electric potential of the connection point P1 in the pixel 20R becomes equal to that of the power supply line Le, resulting in the difference in the electric potential across the storage capacitance 22 being zero, and the drive TFT 23 to being turned off if it is on. Likewise, when the erase scan line YE1B is activated so as to turn on the switching TFT 27 provided in the pixel 20B, the electric potential of the connection point P1 in the pixel 20B becomes equal to that of the power supply line Le, resulting in the difference in the electric potential across the storage capacitance 22 being zero, and the drive TFT 23 to being turned off if it is on.

Referring back to FIG. 2, a plurality of power supply lines Le is wired in the column direction in the display panel 11 and each line is adjacent to the pixel elements 20R, 20G, and 20B. A driving voltage VE is supplied to the power supply lines Le via a power supply line LE. As described above, in the embodiment, the identical driving voltage VE is applied to each of the organic EL elements 25R, 25G, and 25B. Accordingly, the deterioration speed in luminance of each of the organic EL elements 25R, 25G, and 25B can be nearly equalized.

Peripheral Drive Device 2

Figure 4:
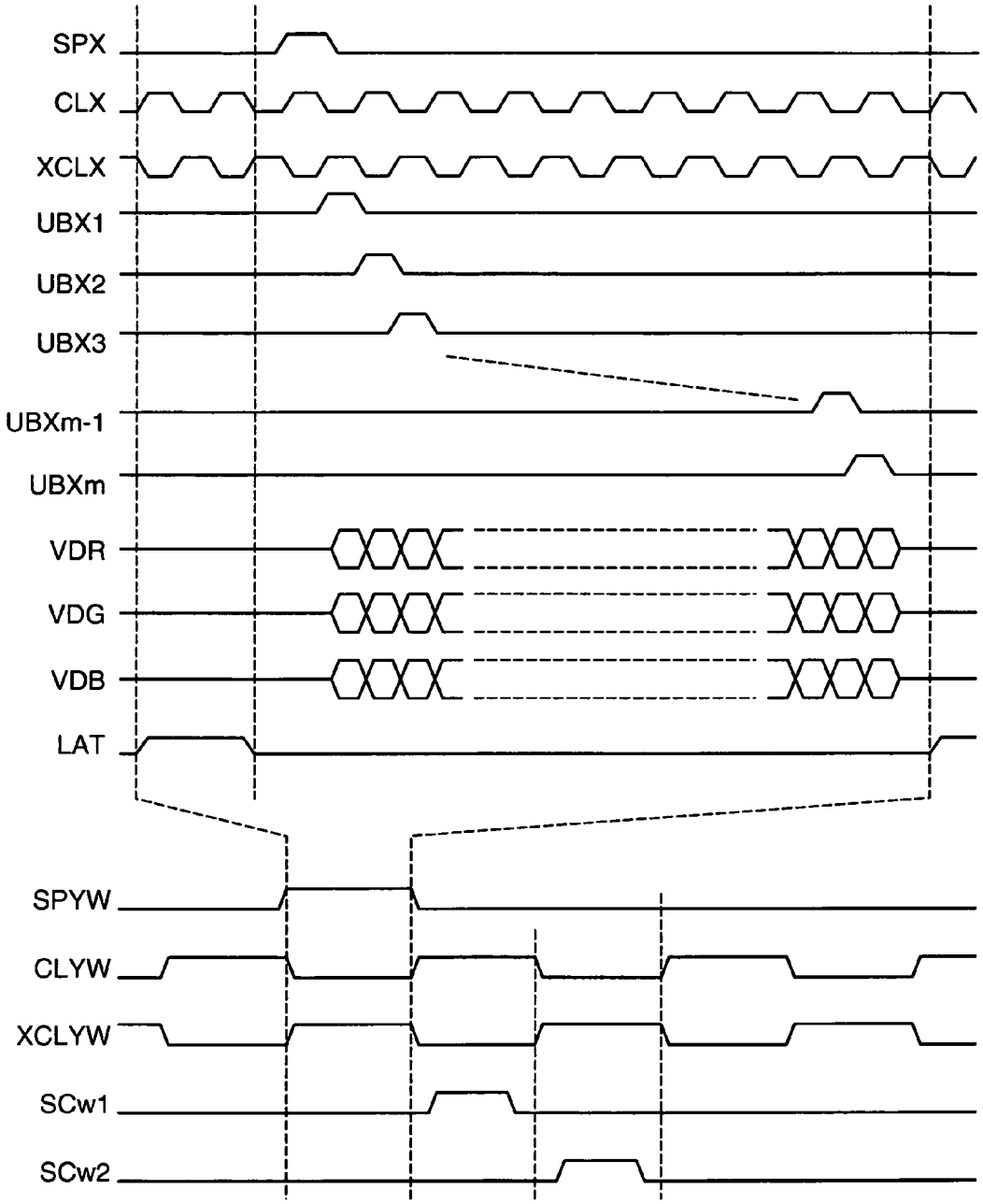
FIG. 4 is a timing chart illustrating signals output from the peripheral drive device 2 to the display panel unit 3 in the first embodiment of the invention.

The peripheral drive device 2 will now be described. As described above, the peripheral drive device 2 outputs the image data and synchronizing signals to the display panel unit 3 synchronously with a basic clock signal CLK. FIG. 4 is a timing chart illustrating signals output from the peripheral drive device 2 to the display panel unit 3 in the first embodiment of the invention. As shown in FIG. 4, the peripheral drive device 2 generates the data driver start pulse SPX, data driver clock signal CLX, and inverted data driver clock signal XCLX, outputting them to the data driver 14 provided in the display panel unit 3.

The data driver start pulse SPX, which is output at every line selection from the write scan lines YW1 to YWn, is the signal for selecting each pixel 20 on the one line selected from the write scan lines YW1 to YWn in a dot sequential manner from the left to right in FIG. 2. The data driver clock signal CLX and inverted data driver clock signal XCLX, which are complementary signals, are the signals for sequentially shifting the data deriver start pulse SPX. In the embodiment, the pixel 20 is composed of a set of the pixel 20R for red, pixel 20G for green, and pixel 20B for blue.

The data driver start pulse SPX is shifted in response to the data driver clock signal CLX and inverted data driver clock signal XCLX, so that the set of the pixels 20R, 20G, and 20B is selected by the data driver start pulse SPX from the left to right in FIG. 2. The peripheral drive device 2 also produces the latch transfer signal LAT based on the basic clock signal CLK, outputting it to the data driver 14. The latch transfer signal LAT is the signal for holding (latching) digital data signals VDR, VDG, and VDB, which are written into each pixel 20 on the selected scan line in the dot sequential manner, at a predetermined timing.

In addition, the peripheral drive device 2 produces, as shown in the time chart of FIG. 4, a write scan driver start pulse SPYW, a write scan driver clock signal CLYW, and an inverted write scan driver clock signal XCLYW based on the basic clock signal CLK, outputting them to the write scan driver 12. The write scan driver start pulse SPYW is output when the scan line YW1 is selected. The scan line YW1 is the uppermost scan line when the write scan lines YW1 to YWn are sequentially selected from top to down in FIG. 2. The write scan driver clock signal CLYW and inverted write scan driver clock signal XCLYW, which are complementary signals, are the signals for sequentially shifting the write scan driver start pulse SPYW in order to sequentially select the write scan lines.

The peripheral drive device 2 produces the digital data signal VDR for red, digital data signal VDG for green, and digital data signal VDB for blue for each pixel 20 (20R, 20G, and 20B) based on image data stored in the main memory unit 5. The peripheral drive device 2 outputs the produced digital data signals VDR, VDG, and VDB to the data driver 14 synchronously with the data driver clock signal CLX and inverted data driver clock signal XCLX.

That is, the peripheral drive device 2 sequentially outputs the digital data signals VDR, VDG, and VDB to each pixel 20 (20R, 20G, and 20B), which is selected on the selected scan line, from the left to right in the dot sequential manner. The scan line is selected synchronously with the data driver clock signal CLX and inverted data driver clock signal XCLX. Each of the digital data signals VDR, VDG, and VDB, which is composed of binary digital data, is the data to determine whether each of the organic EL elements 25R, 25G, and 25B of the corresponding pixel 20 emits light or not. When the digital data signals VDR, VDG, and VDB are a logic level H, light is emitted, while the digital data signals VDR, VDG, and VDB are a logic level L, light is not emitted.

Figure 5:
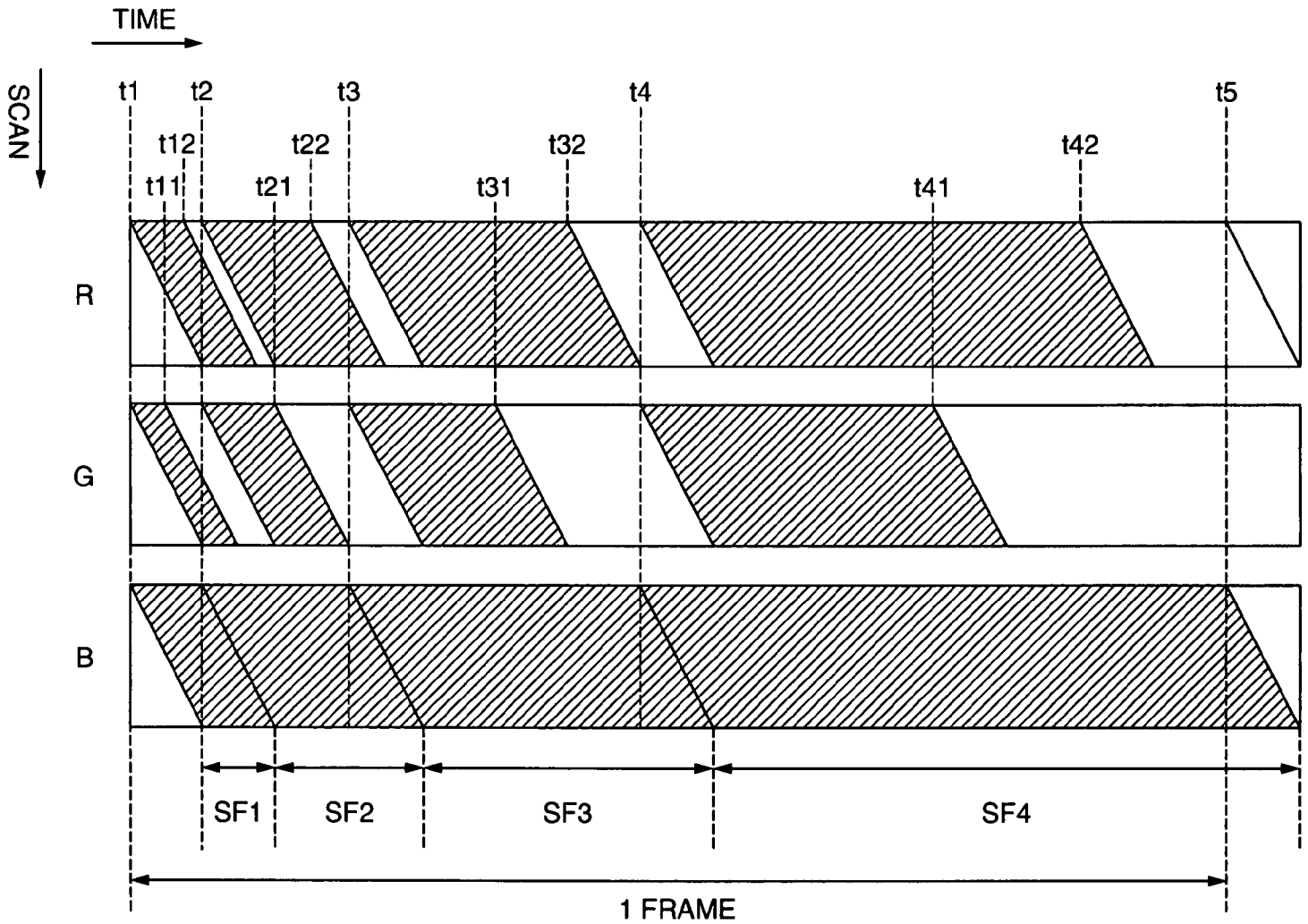
FIG. 5 is a diagram for explaining a driving method according to the second embodiment of the invention.

The peripheral drive device 2 represents a grayscale as follows: one frame is divided into four sub-frames, each having a different time ratio from each other; and the sub-frame to emit light is adequately selected and the write scan lines YW1 to YWn are sequentially selected and activated. FIG. 5 is a diagram for explaining a driving method according to the first embodiment of the invention. As shown in FIG. 5, in order to represent the grayscale of each color in image data with 16 grayscales (4096 colors), one frame is divided into four sub-frames, i.e. a first sub-frame SF1 to a fourth sub-frame SF4. The periods TL1 to TL4, each of which corresponds to each of the first sub-frame SF1 to the fourth sub-frame SF4, are set by the time ratio of TL1:TL2:TL3:TL4=1:2:4:8. This time ratio is merely one example, but any time ratio can be set.

If the image data is 15 grayscales, all from the first sub-frame SF1 to the fourth sub-frame SF4 are selected so as to emit light for the light emitting period T (=TL1+TL2+TL3+TL4). As a result, the light can be emitted that has the luminance of the image data of 15 grayscales. If the image data is 6 grayscales, only the second sub-frame SF2 and the third sub-frame SF3 are selected so as to emit light for the light emitting period T (=TL2+TL3). As a result, the pixel 20 emits the light with the luminance of 6 grayscales. In sum, the largest data current Imax corresponding to 15 grayscales is supplied to the data lines X1 to X3*m*. By changing the light emitting period T depending on the grayscale of image data, the pixel 20 emits light with the luminance corresponding to the grayscale of the image data.

For this reason, the peripheral drive device 2 produces the digital data signals VDR, VDG, and VDB for each pixel 20 and for each of the sub-frames SF 1 to SF4 in one frame based on the image data of each pixel 20. That is, the peripheral drive device 2 produces the digital data signals VDR, VDG, and VDB, each of which is composed of binary data to determine whether each of the organic EL elements 25R, 25G, and 25B emits light or not, in each of the sub-frames SF1 to SF4.

As shown in FIG. 2, the peripheral drive device 2 also produces a scan driver start pulse SPYRE for erasing red, a scan driver start pulse SPYGE for erasing green, a scan driver start pulse SPYBE for erasing blue, an erase scan driver clock signal CLYE, and an inverted erase scan driver clock signal XCLYE based on the basic clock signal CLK, outputting them to the erase scan driver 13.

The scan driver start pulse SPYRE for erasing red is output when the erase scan line YE1R is selected. The erase scan line YE1R is the uppermost line when the erase scan lines YE1R to YEnR are sequentially selected from top to down in FIG. 2. The scan driver start pulse SPYGE for erasing green is output when the erase scan line YE1G is selected. The erase scan line YE1G is the uppermost line when the erase scan lines YE1G to YEnG are sequentially selected from top to down in FIG. 2.

Likewise, the scan driver start pulse SPYBE for erasing blue is output when the erase scan line YE1B is selected. The erase scan line YE1B is the uppermost line when the erase scan lines YE1B to YEnB are sequentially selected from top to down in FIG. 2. The erase scan driver clock signal CLYE and inverted erase scan driver clock signal XCLYE, which are complementary signals, are the signals for sequentially shifting each of the scan driver start pulse SPYRE for erasing red, the scan driver start pulse SPYGE for erasing green, and the scan driver start pulse SPYBE for erasing blue.

The peripheral drive device 2 outputs the write scan driver start pulse SPYW to the write scan driver 12, and then outputs the scan driver start pulse SPYRE for erasing red, the scan driver start pulse SPYGE for erasing green, and the scan driver start pulse SPYBE for erasing blue to the erase scan driver 13 with a predetermined timing, in each of the sub-frames SF1 to SF4. These pulses result in the organic EL elements 25R, 25G, and 25B provided in each pixel 20 being the non-light emission state (erased). As a result, the light emission luminance of each of the organic EL elements 25R, 25G, and 25B is individually adjusted.

Write Scan Driver 12 and Erase Scan Driver 13

Figure 6:
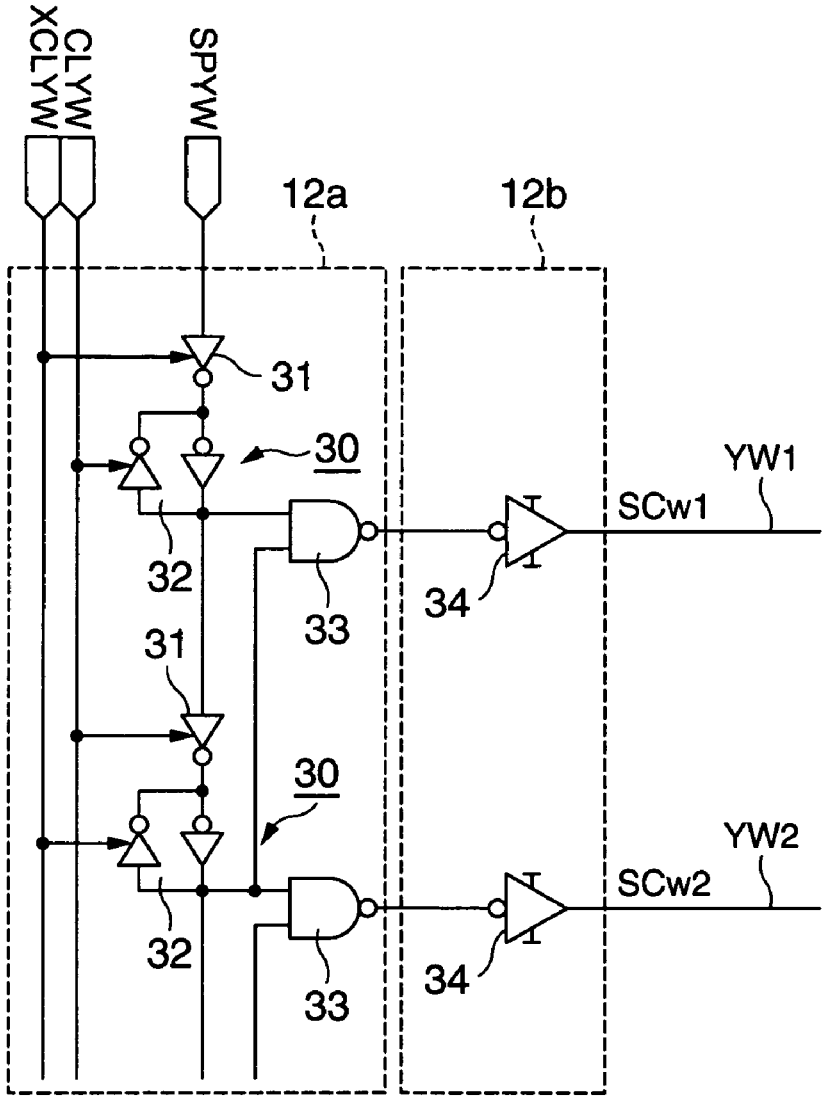
FIG. 6 is a circuit diagram illustrating the structure of a write scan driver 12 included in the organic EL device according to the first embodiment of the invention.

The write scan driver 12 and erase scan driver 13 will be described. FIG. 6 is a circuit diagram illustrating the structure of the write scan driver 12 included in the organic EL device according to the first embodiment of the invention. As shown in FIG. 6, the write scan driver 12 inputs the write scan driver start pulse SPYW, the write scan driver clock signal CLYW, and the inverted write scan driver clock signal XCLYW from the peripheral drive device 2.

The write scan driver 12 is composed of a shift register 12*a* and a level shifter 12*b*. The shift register 12*a* includes n number of storage circuits 30 corresponding to the write scan lines YW1 to YWn, as shown in FIG. 6. Here, in FIG. 6, only two storage circuits 30 are illustrated for simplifying the illustration. Each storage circuit 30 includes an inverter circuit 31, a latch part 32, and a NAND circuit 33.

The inverted write scan driver clock signal XCLYW is input to the inverter circuit 31 of the storage circuit 30 located at the odd-numbered stage as a synchronous signal, while the write scan driver clock signal CLYW is input to the inverter circuit 31 of the storage circuit 30 located at the even-numbered stage as a synchronous signal. The inverter circuit 31 of the storage circuit 30 located at the odd-numbered stage inputs the write scan driver start pulse SPYW in response to a rise of the inverted write scan driver clock signal XCLYW so as to output it to the latch part 32. The inverter circuit 31 of the storage circuit 30 located at the even-numbered stage inputs the write scan driver start pulse SPYW in response to a rise of the write scan driver clock signal CLYW so as to output it to the latch part 32.

The latch part 32 of each storage circuit 30 is composed of two inverter circuits. The write scan driver clock signal CLYW is input to the latch part 32 of the storage circuit 30 located at the odd-numbered stage as a synchronous signal, while the inverted write scan driver clock signal XCLYW is input to the latch part 32 of the storage circuit 30 located at the even-numbered stage as a synchronous signal. The latch part 32 of the storage circuit 30 located at the odd-numbered stage inputs the write scan driver start pulse SPYW from the inverter circuit 31 in response to a rise of the write scan driver clock signal CLYW so as to hold it. The latch part 32 of the storage circuit 30 located at the even-numbered stage inputs the write scan driver start pulse SPYW from the inverter circuit 31 in response to a rise of the inverted write scan driver clock signal XCLYW so as to hold it. Each latch part 32 outputs the held write scan driver start pulse SPYW to the inverter circuit 31 of the storage circuit 30 located at the next stage. Accordingly, the write scan driver start pulse SPYW having the logic level H that is output from the control circuit 12 is sequentially shifted from the storage circuit 30 of the write scan line YW1 to the storage circuit 30 of the write scan line YWn synchronously with the write scan driver clock signal CLYW and inverted write scan driver clock signal XCLYW.

In the NAND circuit 33 provided in the storage circuit 30, one input terminal is connected to the output terminal of the latch part 32, the other input terminal is connected to the output terminal of the latch part 32 provided in the storage circuit 30 in the next stage. Therefore, the NAND circuit 33 in each storage circuit 30 outputs a signal having logic level L when the latch part 32 of the storage circuit 30 and the latch part 32 of the storage circuit 30 in the next stage hold the write scan driver start pulse SPYW having the logic level H. Then, the NAND circuit 33 outputs a signal having the logic level H when the latch part 32 of the storage circuit 30, which includes the NAND circuit 33, shifts the write scan driver start pulse SPYW. The NAND circuit 33 continues outputting the signal having the logic level H until when the latch parts 32, which are input to the NAND circuit 33, hold the new write scan driver start pulse SPYW. Here, the period from a fall to the logic level L to rise to the logic level H of the signal output from the storage circuit 30 (NAND circuit 33) is half of the period of the write scan driver clock signal CLYW (inverted write scan driver clock signal XCLYW).

The signal from the NAND circuit 33 provided in each storage circuit 30 is output to the level shifter 12*b*. The level shifter 12*b* includes n number of buffer circuits 34 each of which corresponds to each storage circuit 30, as shown in FIG. 6. The buffer circuits 34 are connected to respective write scan lines YW1 to YWn. Accordingly, the buffer circuits 34 input the signals from respective storage circuits 30 and output as respective write scan signals SCw1 to SCwn to respective write scan lines YW1 to YWn. The level shifter 12*b* selects write scan lines YW1 to YWn by respective write scan signals SCw1 to SCwn in a line-sequential manner, writing data currents Id1 to Id3*m*, which correspond to image data, into the pixel 20 connected to the selected write scan line.

The erase scan driver 13 inputs the scan driver start pulse SPYRE for erasing red, scan driver start pulse SPYGE for erasing green, scan driver start pulse SPYBE for erasing blue, erase scan driver clock signal CLYE, and inverted erase scan driver clock signal XCLYE from the peripheral drive device 2, as shown in FIG. 2. The erase scan driver 13 is composed of a shift register 13*a* and a level shifter 13*b*.

In the shift register 13*a*, the shift register 12*a* shown in FIG. 6 is provided to each of groups of the erase scan lines YE1R to YEnR, erase scan lines YE1G to YEnG, and erase scan lines YE1B to YEnB. That is, the shift register 13*a* is composed of the following three shift registers: a first shift register inputting the scan driver start pulse SPYRE for erasing red, erase scan driver clock signal CLYE, and inverted erase scan driver clock signal XCLYE; a second shift register inputting the scan driver start pulse SPYGE for erasing green, erase scan driver clock signal CLYE, and inverted erase scan driver clock signal XCLYE; and a third shift register inputting the scan driver start pulse SPYBE for erasing blue, erase scan driver clock signal CLYE, and inverted erase scan driver clock signal XCLYE.

In the level shifter 13*b*, the level shifter 12*b* shown in FIG. 6 is provided to each of groups of the erase scan lines YE1R to YEnR, erase scan lines YE1G to YEnG, and erase scan lines YE1B to YEnB. That is, the level shifter 13 *b* is composed of the following three level shifters: a first level shifter including n number of buffer circuits (a structure comparable to the buffer circuit 34 in the level shifter 12*b*) that correspond to respective n number of storage circuits (circuit comparable to the storage circuit 30 in the shift register 12*a*) provided in the first shift register; a second level shifter including n number of buffer circuits (a structure comparable to the buffer circuit 34 in the level shifter 12*b*) that correspond to respective n number of storage circuits (circuit comparable to the storage circuit 30 in the shift register 12*a*) provided in the second shift register; and a third level shifter including n number of buffer circuits (a structure comparable to the buffer circuit 34 in the level shifter 12*b*) that correspond to respective n number of storage circuits (circuit comparable to the storage circuit 30 in the shift register 12*a*) provided in the third shift register. Here, the explanation on the operation of the shift register 13*a* and level shifter 13*b* will be omitted since it is the same as that of the shift register 12*a* and level shifter 12*b*.

Data Driver 14

Figure 7:
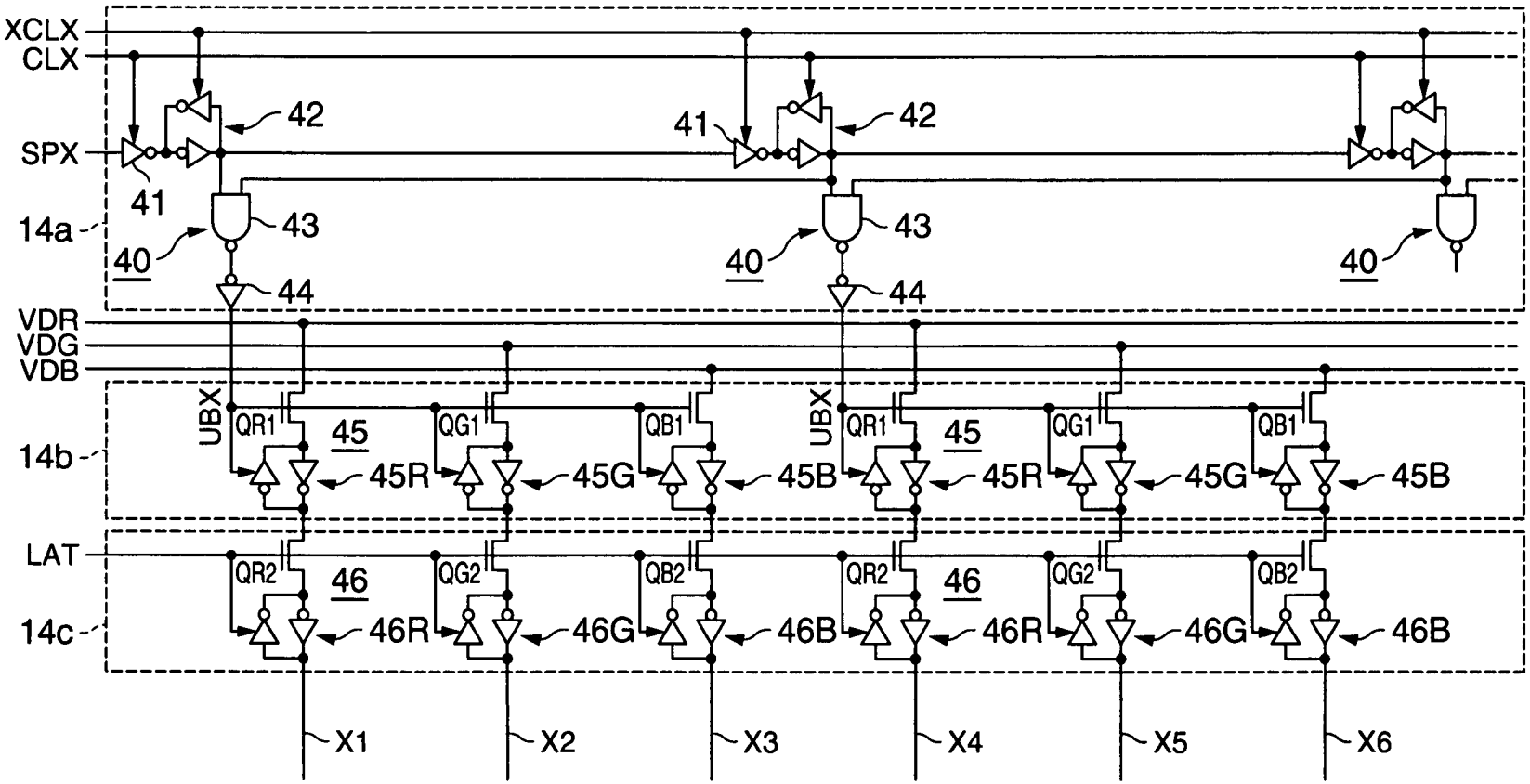
FIG. 7 is a block diagram illustrating the structure of a data driver 14 included in the organic EL device according to the first embodiment of the invention.

Next, the data driver 14 will be described. FIG. 7 is a block diagram illustrating the structure of the data driver 14 included in the organic EL device according to the first embodiment of the invention. As shown in FIG. 7, the data driver 14 inputs the data driver start pulse SPX, data driver clock signal CLX, and inverted data driver clock signal XCLX from the peripheral drive device 2.

Data driver 14 also inputs the digital data signal VDR for red, digital data signal VDG for green, and digital data signal VDB for blue from the peripheral drive device 2. In addition, the data driver 14 inputs the latch transfer signal LAT from the peripheral drive device 2. Then, the data driver 14 supplies the data currents Id1 to Id3*m* to each of the data lines X1 to X3*m* for activating each of the data lines X1 to X3*m* synchronously with the selecting operation of the write scan lines YW1 to YWn based on these signals.

The data driver 14 is composed of a shift register 14*a*, a first latch circuit 14*b*, and a second latch circuit 14*c*. Hereinafter, each component will be described one by one.

Shift Register 14*a*

As shown in FIG. 7, the shift register 14*a* is structured with 3m number of data lines X1 to X3*m*, and m number of storage circuits 40 each of which corresponds to a group composed of three data lines i.e. m number of groups in total, same as the number of storage circuits 40. Here, in FIG. 7, only three storage circuits 40 are illustrated for simplifying the illustration. Each storage circuit 40 includes an inverter circuit 41, a latch part 42, a NAND circuit 43, and an inverter circuit 44.

As for the inverter circuit 41 in each storage circuit 40, the data driver clock signal CLX is input to the inverter circuit 41 of the storage circuit 40 located at the odd-numbered stage as a synchronous signal, while the inverted data driver clock signal XCLX is input to the inverter circuit 41 of the storage circuit 40 located at the even-numbered stage as a synchronous signal. The inverter circuit 41 of the storage circuit 40 located at the odd-numbered stage inputs the data driver start pulse SPX in response to a rise of the data driver clock signal CLX so as to output it to the latch part 42. The inverter circuit 41 of the storage circuit 40 located at the even-numbered stage inputs the data driver start pulse SPX in response to a rise of the inverted data driver clock signal XCLX so as to output it to the latch part 42.

The latch part 42 of each storage circuit 40 is composed of two inverter circuits. The inverted data driver clock signal XCLX is input to the latch part 42 of the storage circuit 40 located at the odd-numbered stage as a synchronous signal, while the data driver clock signal CLX is input to the latch part 42 of the storage circuit 40 located at the even-numbered stage as a synchronous signal. The latch part 42 of the storage circuit 40 located at the odd-numbered stage inputs the data driver start pulse SPX from the inverter circuit 41 in response to a rise of the inverted data driver clock signal XCLX so as to hold it. The latch part 42 of the storage circuit 40 located at the even-numbered stage inputs the data driver start pulse SPX from the inverter circuit 41 in response to a rise of the data driver clock signal CLX so as to hold it. Each latch part 42 outputs the held data driver start pulse SPX to the inverter circuit 41 of the storage circuit 40 located at the next stage.

Accordingly, the data driver start pulse SPX having the logic level H that is output from the peripheral drive device 2 is sequentially shifted from the storage circuit 40, which corresponds to three data lines X1 to X3, to the storage circuit 40, which corresponds to three data lines X3*m*−2 to X3*m*, synchronously with the data driver clock signal CLX and inverted data driver clock signal XCLX.

In the NAND circuit 43 in the storage circuit 40, one input terminal is connected to the output terminal of the latch part 42, the other input terminal is connected to the output terminal of the latch part 42 provided in the storage circuit 40 in the next stage. Therefore, the NAND circuit 43 in each storage circuit 40 outputs a signal having the logic level L when both the latch parts 42 of the storage circuit 40 and the storage circuit 40 in the next stage hold the data driver start pulse SPX having the logic level H. Then, the NAND circuit 43 outputs a signal having the logic level H when the latch part 42 of the storage circuit 40, which includes the NAND circuit 43, shifts the data driver start pulse SPX. The NAND circuit 43 continues outputting the signal having the logic level H until when the latch parts 42 hold, which are input to the NAND 43, a new data driver start pulse SPX.

Here, the period from a fall to the logic level L to rise to the logic level H of the signal output from the storage circuit 40 (NAND circuit 43) is half of the period of the data driver clock signal CLX (inverted data driver clock signal XCLX). The output signal from the NAND circuit 43 provided in each storage circuit 40 is inverted by the inverter circuit 44 so as to be output as an inverted output signal UBX to the first latch circuit 14*b*. In FIG. 4, the inverted output signal UBX based on m number of the NAND circuits 43 is shown as UBX1, UBX2, UBX3, . . . , UBXm−1, UBXm, each of which sequentially corresponds to the NAND circuit 43 from the left in FIG. 7.

First Latch Circuit 14*b*

The first latch circuit 14*b* inputs the inverted output signal UBX sequentially output from each storage circuit 40 provided in the shift register 14*a*. The first latch circuit 14*b* also inputs the digital data signal VDR for the pixel 20R, digital data signal VDG for the pixel 20G, and digital data signal VDB for the pixel 20B synchronously with the inverted output signal UBX sequentially output from each storage circuit 40.

The first latch circuit 14*b* includes first memory parts 45 of the same number of storage circuits 40. Each of the first memory parts 45 is composed of three latch parts 45R, 45G, and 45B, and three switches QR1, QG1, and QB1, each of which switches is N-channel MOS transistor. The switches QR1, QG1, and QB1, each having the gate to which the inverted output signal UBX is input, are turned on when the inverted output signal UBX having the logic level H is input.

The latch part 45R is composed of two inverter circuits to which the digital data signal VDR for red is input via the switch QR1. The latch part 45G is composed of two inverter circuits to which the digital data signal VDG for green is input via the switch QG1. Likewise, the latch part 45B is composed of two inverter circuits to which the digital data signal VDB for blue is input via the switch QB1.

Each of the latch part 45R, 45G, and 45B respectively holds the digital data signal VDR for red, digital data signal VDG for green, and digital data signal VDB for blue that are out put from the peripheral drive device 2 at the time in response to the inverted output signal UBX having the logic level H from respective storage circuits 40. That is, in the first latch circuit 14*b*, each first memory part 45, sequentially from the left in FIG. 7, stores the digital data signal VDR for red, digital data signal VDG for green, and digital data signal VDB for blue in response to the inverted output signal UBX that are output from respective storage circuits 40. Each of the digital data signal VDR, VDG, and VDB stored in each first memory part 45 is output to the second latch circuit 14*c*.

Second Latch Circuit 14*c*

The second latch circuit 14*c* includes second memory parts 46 of the same number of first memory parts 45. Each of the second memory parts 46 is composed of three latch parts 46R, 46G, and 46B, and three switches QR2, QG2, and QB2, each of which switches is N-channel MOS transistor. The switches QR2, QG2, and QB2, each having the gate to which the latch transfer signal LAT is input, are turned on when the latch transfer signal LAT having the logic level H is input.

The latch part 46R is composed of two inverter circuits to which the digital data signal VDR for red that is held by the latch part 45R in the former stage is input via the switch QR2. The latch part 46G is composed of two inverter circuits to which the digital data signal VDG for green that is held by the latch part 45G in the former stage is input via the switch QG2. Likewise, the latch part 46B is composed of two inverter circuits to which the digital data signal VDB for blue that is held by the latch part 45B in the former stage is input via the switch QB2.

In the second memory part 46, each of the latch parts 46R, 46G, and 46B holds the digital data signal VDR for red, digital data signal VDG for green, and digital data signal VDB for blue, from respective latch parts 45R, 45G, and 45B of respective first memory parts 45 in response to the latch transfer signal LAT having the logic level H. The latch transfer signal LAT having the logic level H is simultaneously output to all of the second memory parts 46 in the second latch circuit 14*c*. Therefore, each of the digital data signals VDR, VDG, and VDB stored in all of the first memory parts 45 in the first latch circuit 14*b* is stored all at once into respective second memory parts 46 in the second latch circuit 14*c*. Then, each of digital data signals VDR, VDG, and VDB stored in each second memory part 46 in the second latch circuit 14*c* is output to each of the data lines X1 to X3*m* as respective data currents Id1 to Id3*m*.

Next, the operation of the organic EL device 1 structured as described above will be described. First, the central processing unit (CPU) included in the peripheral drive device 2 reads image data stored in the main memory unit 5, carries out various types of processing, such as expansion process, with the main memory unit 5, and outputs processed data to the graphics controller 6. When receiving the image data of one frame, the graphics controller 6 produces the digital data signals VDR, VDG, and VDB for each of the first sub-frame SF1 to fourth sub-frame SF4 of each pixel 20. Upon completion of producing the digital data signals VDR, VDG, and VDB for the first sub-frame SF1 to fourth sub-frame SF4 of one frame for each pixel 20, the graphics controller 6 outputs them to the VRAM 9 as well as synchronous signals to the timing controller 8.

Then, the digital data signals VDR, VDG, and VDB are output to the data driver 14 with the data driver start pulse SPX, data driver clock signal CLX, inverted data driver clock signal XCLX, and latch transfer signal LAT. In addition, the write scan driver start pulse SPYW, write scan driver clock signal CLYW, and inverted write scan driver clock signal XCLYW are output to the write scan driver 12. As a result, a display appears on the display panel 11

Upon completion of the output of these signals, the write scan line YW1 is selected at the time t1 in FIG. 5. Then, the organic EL elements 25R, 25G, and 25B provided in the pixel 20 connected to the write scan line YW1 start emitting light at the same timing. Subsequently, the write scan line YW2 is selected. Then, the organic EL elements 25R, 25G, and 25B provided in the pixel 20 connected to the write scan line YW2 start emitting light at the same timing. Likewise, the write scan lines YW3 to YWn are sequentially selected so that the organic EL elements 25R, 25G, and 25B provided in the pixel 20 connected to each of the write scan lines YW3 to YWn start emitting light at the same timing.

At the time till, after a predetermined period from the time t1, during the scanning of the write scan lines YW3 to YWn, the scan driver start pulse SPYGE for erasing green is output to the erase scan driver 13 from the timing controller 8 in the peripheral drive device 2 with the erase scan driver clock signal CLYE and inverted erase scan driver clock signal XCLYE. Upon completion of the output of these signals, the erase scan line YE1G is selected at the time t11 in FIG. 5, resulting in the organic EL element 25G provided in the pixel 20 connected to the erase scan line YE1G being the non-light emission state (erased). Subsequently, the erase scan line YE2G is selected, resulting in the organic EL element 25G provided in the pixel 20 connected to the erase scan line YE2G being the non-light emission state (erased). Likewise, the erase scan lines YE3G to YEnG are sequentially selected, sequentially resulting in the organic EL element 25G provided in the pixel 20 connected to each of the erase scan lines YE3G to YEnG being the non-light emission state (erased).

At the time t12, after a predetermined period from the time t1, during the scanning of the write scan lines YW3 to YWn, the scan driver start pulse SPYRE for erasing red is output to the erase scan driver 13 from the timing controller 8 in the peripheral drive device 2 with the erase scan driver clock signal CLYE and inverted erase scan driver clock signal XCLYE. Upon completion of the output of these signals, the erase scan line YE1R is selected at the time t12 in FIG. 5, resulting in the organic EL element 25R provided in the pixel 20 connected to the erase scan line YE1R being the non-light emission state (erased). Subsequently, the erase scan line YE2R is selected, resulting in the organic EL element 25R provided in the pixel 20 connected to the erase scan line YE2R being the non-light emission state (erased). Likewise, the erase scan lines YE3R to YEnR are sequentially selected, sequentially resulting in the organic EL element 25R provided in the pixel 20 connected to each of the erase scan lines YE3R to YEnR being the non-light emission state (erased).

Here, At the time, after a predetermined period from the time t1, during the scanning of the write scan lines YW3 to YWn, the scan driver start pulse SPYBE for erasing blue can be output to the erase scan driver 13 from the timing controller 8 in the peripheral drive device 2 with the erase scan driver clock signal CLYE and inverted erase scan driver clock signal XCLYE. As a result, the organic EL elements 25B provided in the pixels 20 connected to the erase scan lines YE1B to YEnB can be the non-light emission state (erased). However, in the embodiment, the light emitting time of the organic EL element 25B is set as the same as the period of each sub-frame. Thus, no control carried out to render the organic EL element 25 B to be the non-light emission state (erased).

Upon completion of scanning the sub-frame SF1, in which the write scan lines YW1 to YWn have been scanned, the scanning of the sub-frame SF2 starts. Upon selecting the write scan line YW1 at the time t2 in FIG. 5, the scanning of the sub-frame SF2 starts. Then, the organic EL elements 25R, 25G, and 25B provided in the pixel 20 connected to the write scan line YW1 start emitting light at the same timing. Subsequently, the write scan line YW2 is selected. Then, the organic EL elements 25R, 25G, and 25B provided in the pixel 20 connected to the write scan line YW2 start emitting light at the same timing. Likewise, the write scan lines YW3 to YWn are sequentially selected so that the organic EL elements 25R, 25G, and 25B provided in the pixel 20 connected to each of the write scan lines YW3 to YWn start emitting light at the same timing.

At the time t21, after a predetermined period from the time t2, during the scanning of the write scan lines YW3 to YWn, the scan driver start pulse SPYGE for erasing green is output to the erase scan driver 13 from the timing controller 8 in the peripheral drive device 2 with the erase scan driver clock signal CLYE and inverted erase scan driver clock signal XCLYE. Upon completion of the output of these signals, the erase scan line YE1G is selected at the time t21 in FIG. 5, resulting in the organic EL element 25G provided in the pixel 20 connected to the erase scan line YE1G being the non-light emission state (erased). Subsequently, the erase scan line YE2G is selected, resulting in the organic EL element 25G provided in the pixel 20 connected to the erase scan line YE2G being the non-light emission state (erased). Likewise, the erase scan lines YE3G to YEnG are sequentially selected, sequentially resulting in the organic EL element 25G provided in the pixel 20 connected to each of the erase scan lines YE3G to YEnG being the non-light emission state (erased).

At the time t22, after a predetermined period from the time t2, during the scanning of the write scan lines YW3 to YWn, the scan driver start pulse SPYRE for erasing red is output to the erase scan driver 13 from the timing controller 8 in the peripheral drive device 2 with the erase scan driver clock signal CLYE and inverted erase scan driver clock signal XCLYE. Upon completion of the output of these signals, the erase scan line YE1R is selected at the time t22 in FIG. 5, resulting in the organic EL element 25R provided in the pixel 20 connected to the erase scan line YE1R being the non-light emission state (erased). Subsequently, the erase scan line YE2R is selected, resulting in the organic EL element 25G provided in the pixel 20 connected to the erase scan line YE2R being the non-light emission state (erased). Likewise, the erase scan lines YE3R to YEnR are sequentially selected, sequentially resulting in the organic EL element 25R provided in the pixel 20 connected to each of the erase scan lines YE3R to YEnR being the non-light emission (erased).

Upon completion of scanning the sub-frame SF2, in which the write scan lines YW1 to YWn have been scanned, the scanning of the sub-frame SF3 starts from the time t3. As for the sub-frame SF3, the write scan lines YW1 to YWn are sequentially scanned from the time t3. At the time t31, after a predetermined period from the time t3, during the scan, the scanning of the erase scan lines YE1G to YEnG starts sequentially, while at the time t32, after a predetermined period from the time t3, the scanning of the erase scan lines YE1R to YEnR starts sequentially. Upon completion of scanning the sub-frame SF3, in which the write scan lines YW1 to YWn have been scanned, the scanning of the sub-frame SF4 starts from the time t4. As for the sub-frame SF4, the write scan lines YW1 to YWn are sequentially scanned from the time t4. At the time t41, after a predetermined period from the time t4, during the scan, the scanning of the erase scan lines YE1G to YEnG starts sequentially, while at the time t42, after a predetermined period from the time t4, the scanning of the erase scan lines YE1R to YEnR starts sequentially.

Each light emitting time of the organic EL elements 25R, 25G, and 25B is determined by the luminance ratio obtained from the chromatic coordinate and the light emitting efficiency of each of the organic EL elements 25R, 25G, and 25B, the current to achieve the luminance ratio, and the current-voltage characteristic (I-V characteristic) of each of the organic EL elements 25R, 25G, and 25B. In an example shown in FIG. 5, the light emitting time of the organic EL elements 25R, 25G, and 25B are set in ratio of 0.75:0.5:1. Here, the light emitting time ratio among the organic EL elements 25R, 25G, and 25B is preferably adjusted so that a predetermined white balance is achieved. While the light emitting ratio among the organic EL elements 25R, 25G, and 25B is preferably set a constant value in all of the sub-frames SF1 to SF4, but it can be set different in each of the sub-frames SF1 to SF4. While a case in which each color is displayed in 16 grayscales is described in the embodiment as an example, but the invention can be applied to cases in which any grayscales, e.g. 32 gray scales, 128 gray scales, or 256 gray scales or the like, are displayed.

As described above, in the embodiment, the light emitting time of the organic EL elements 25R, 25G, and 25B is adjusted by adjusting the timing for scanning the erase scan lines YE1R to YEnR, YE1G to YEnG, and YE1B to YEnB. As a result, the luminance ratio among red, green, and blue light is adjusted. Consequently, red, green, and blue light can be set as a predetermined luminance ratio even if the organic EL elements 25R, 25G, and 25B differ in characteristics.

Second Embodiment

Next, a second embodiment according to the invention will be described. The organic EL device of the second embodiment, which is nearly the same as that shown in FIG. 1 in electrical structure, differs in that the peripheral drive device 2 produces analog image signals VAR, VAG, and VDB instead of the digital data signals VDR, VDG, and VDB, and outputs them to the display panel unit 3. In the first embodiment, one frame is divided into a plurality of sub-frames since the digital data signals VDR, VDG, and VDB are used, and employs a time division grayscale scheme in which grayscale is represented by adequately selecting the sub-frame to emit light. In contrast, the second embodiment differs in that the frame is driven one by one since the analog image signals VAR, VDG, and VDB are used instead of the digital data signals VDR, VDG, and VDB.

Display Panel Unit 3

Figure 8:
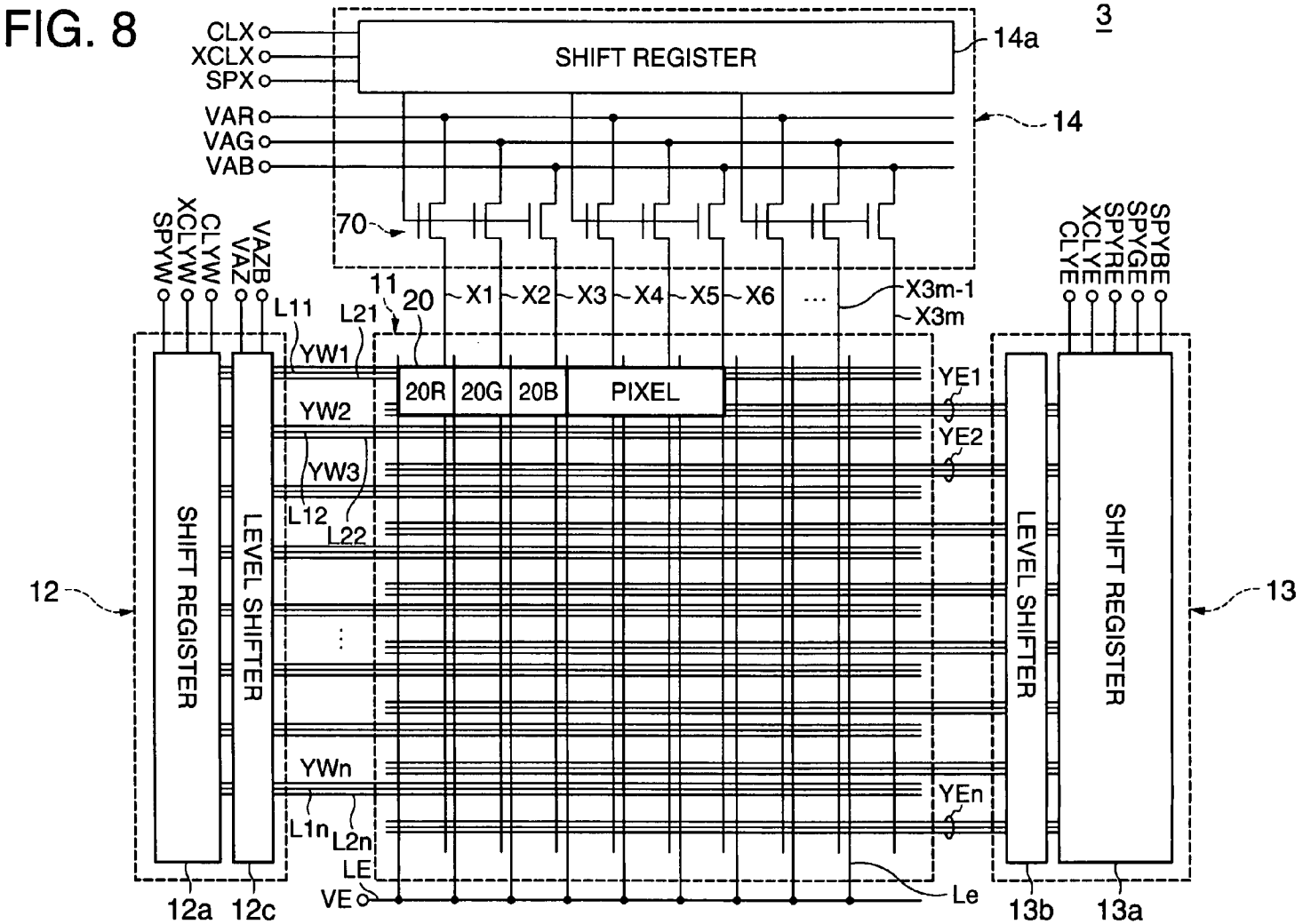
FIG. 8 is a block diagram illustrating the structure of a display panel unit included in an organic EL device according to a second embodiment of the invention.

FIG. 8 is a block diagram illustrating the structure of the display panel unit included in the organic EL device according to the second embodiment of the invention. In FIG. 8, the same numeral is given to the same structure as that or equivalent structure to that shown in FIG. 2. As shown in FIG. 8, the display panel 11 included in the display panel unit 3 includes n number of write scan lines YW1 to YWn (n is a natural number) extending in the row direction, and 3n number of erase scan lines YE1 to YEn extending in the row direction in the same manner as the first embodiment.

In addition, the display panel 11 includes n number of control lines L11 to L1*n* for storing a threshold each of which lines is provided to respective write scan lines YW1 to YWn and is extended in the row direction, and n number of control lines L21 to L2*n* for controlling a light emission each of which lines is provided respective write scan lines YW1 to YWn. Further, the display panel 11 includes 3m number of data lines X1 to X3*m* extending in the column direction perpendicular to the row direction. Each of the pixels 20R, 20G, and 20B is arrayed in a matrix at each of the intersections of the write scan lines YW1 to YWn (erase scan lines YE1 to YEn) and the data lines X1 to X3*m*.

Figure 9:
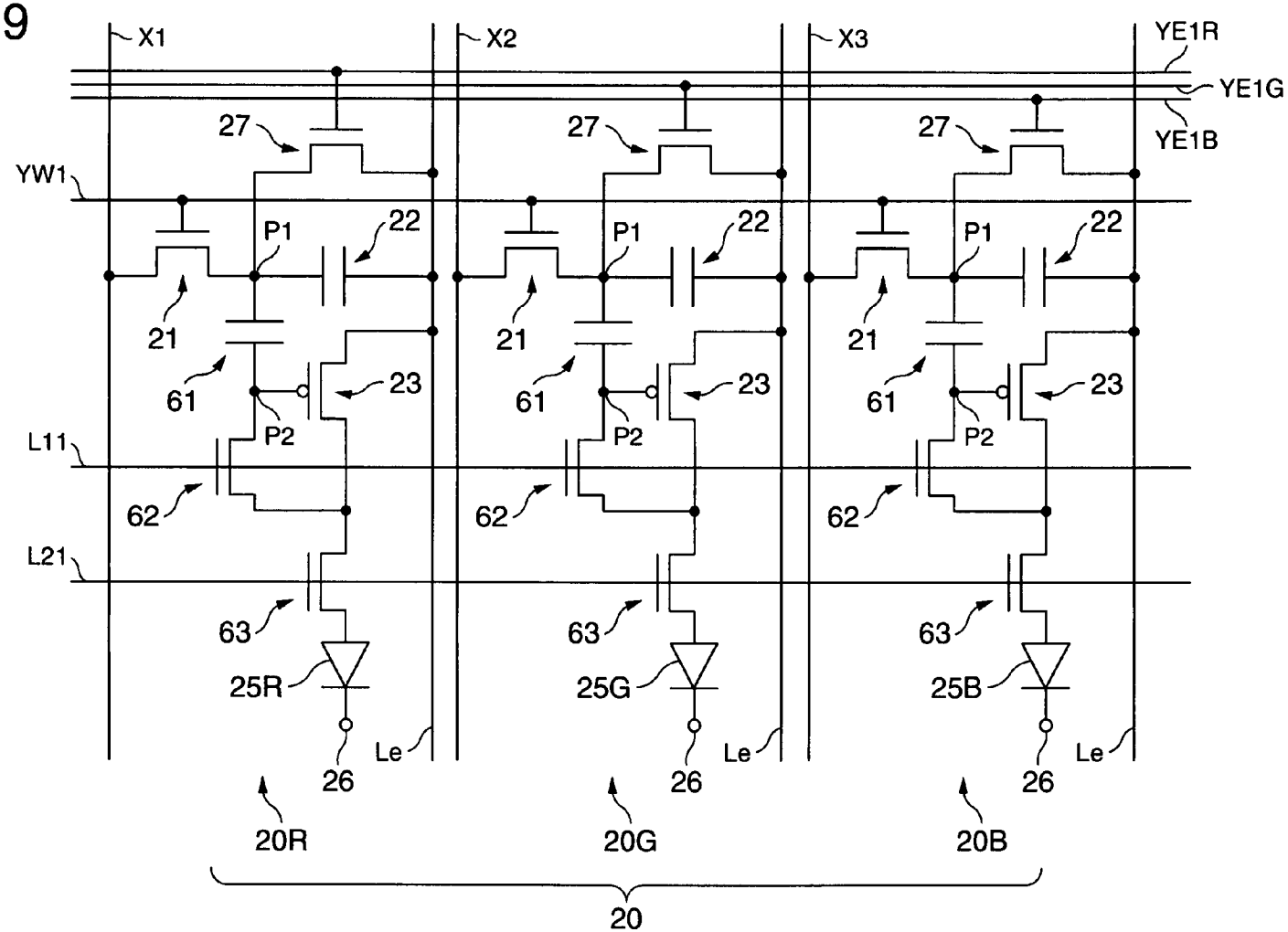
FIG. 9 is a circuit diagram illustrating the structure of a pixel 20 located at the upper left corner of the display panel included in the organic EL device according to the second embodiment of the invention.

FIG. 9 is a circuit diagram illustrating the structure of the pixel 20 located at the upper left corner of the display panel included in the organic EL device according to the second embodiment of the invention. As shown in FIG. 9, the pixel 20 on the upper left corner of the display panel 11 includes the pixel 20R emitting red light, the pixel 20G emitting green light, and the pixel 20B emitting blue light. In this regard, the other pixels provided on the display panel 11 also have the structure composed of the pixels 20R, 20G, and 20B, which will be described below.

In the same manner as the first embodiment, each of the pixels 20R, 20G, and 20B includes respective organic EL elements 25R, 25G, and 25B. Each of the pixels 20R, 20G, and 20B includes the switching TFT 21, storage capacitor 22, drive TFT 23, organic EL element 25R, common electrode 26, and switching TFT 27. Moreover, in the embodiment, each of the pixels 20R, 20G, and 20B includes a storage capacitor 61, a transistor 62 for storing a threshold, and a transistor 63 for controlling a light emission.

The storage capacitor 61 stores (holds) a threshold voltage to turn on the drive TFT 23. In the storage capacitor 61, one electrode is connected to the connection point P1 of the switching TFT 21, storage capacitor 22, and drive TFT 23, while the other electrode is connected to the gate electrode of the drive TFT 23. The transistor 62 for storing a threshold controls whether the threshold in the drive TFT 23 is stored (held) in the storage capacitor 61 or not. In the transistor 62 for storing a threshold, the gate electrode is connected to the control line L11 for storing a threshold, the source electrode is connected to the connection point P2 of the storage capacitor 61 and the gate electrode of the drive TFT 23, and the drain electrode is connected to the source electrode of the transistor 63 for controlling a light emission.

The transistor 63 for controlling a light emission controls to make the organic EL elements 25R, 25G, and 25B a state capable to emit light or a state of non-light emission. In the transistor 63 for controlling a light emission, the gate electrode is connected to the control line L21 for controlling a light emission, the source electrode is connected to the pixel electrode 24, and the drain electrode is connected to the organic EL element (the organic EL element 25R in the pixel 20R, the organic EL element 25G in the pixel 20G, and the organic EL element 25B in the pixel 20B).

Referring back to FIG. 8, the write scan driver 12 provided in the display panel unit 3 is composed of the shift register 12*a* and level shifter 12*c* that are described in the first embodiment. The basic structure of the level shifter 12*c* is the same as that of the level shifter described in the first embodiment. However, the level shifter 12*c* differs in that a control signal VAZ for storing a threshold to activate the control lines L11 to L1*n* for storing a threshold, and a control signal VAZB for controlling a light emission to activate the control lines L21 to L2*n* for controlling a light emission are input. The data driver 14 includes the shift register 14*a* described in the first embodiment, and a plurality of transistors 70 provided instead of the first latch circuit 14*b* and second latch circuit 14*c* that are shown in FIG. 3. Here, the erase scan driver 13 has the same structure as that described in the first embodiment.

Next, the operation of the organic EL device 1 structured as described above will be described. First, the central processing unit (CPU) included in the peripheral drive device 2 reads image data stored in the main memory unit 5, carries out various types of processing, such as expansion process, with the main memory unit 5, and outputs processed data to the graphics controller 6. When receiving the image data of one frame, the graphics controller 6 produces the analog image signals VAR, VAG, and VAB for each pixel 20. Upon completion of producing the analog image signals VAR, VAG, and VAB for each pixel 20 of one frame, the graphics controller 6 outputs them to the VRAM 9 as well as synchronous signals to the timing controller 8.

Then, the analog image signals VAR, VAG, and VAB are output to the data driver 14 with the data driver start pulse SPX, data driver clock signal CLX, and inverted data driver clock signal XCLX that are shown in FIG. 8. Also, the write scan driver start pulse SPYW, write scan driver clock signal CLYW, inverted write scan driver clock signal XCLYW, control signal VAZ for controlling a threshold, and control signal VAZB for controlling a light emission are output to the write scan driver 12. Moreover, the scan driver start pulse SPYRE for erasing red, scan driver start pulse SPYGE for erasing green, scan driver start pulse SPYBE for erasing blue, erase scan driver clock signal CLYE and inverted erase scan driver clock signal XCLYE are output to the erase scan driver 13. As a result, a display appears on the display panel 11.

Figure 10:
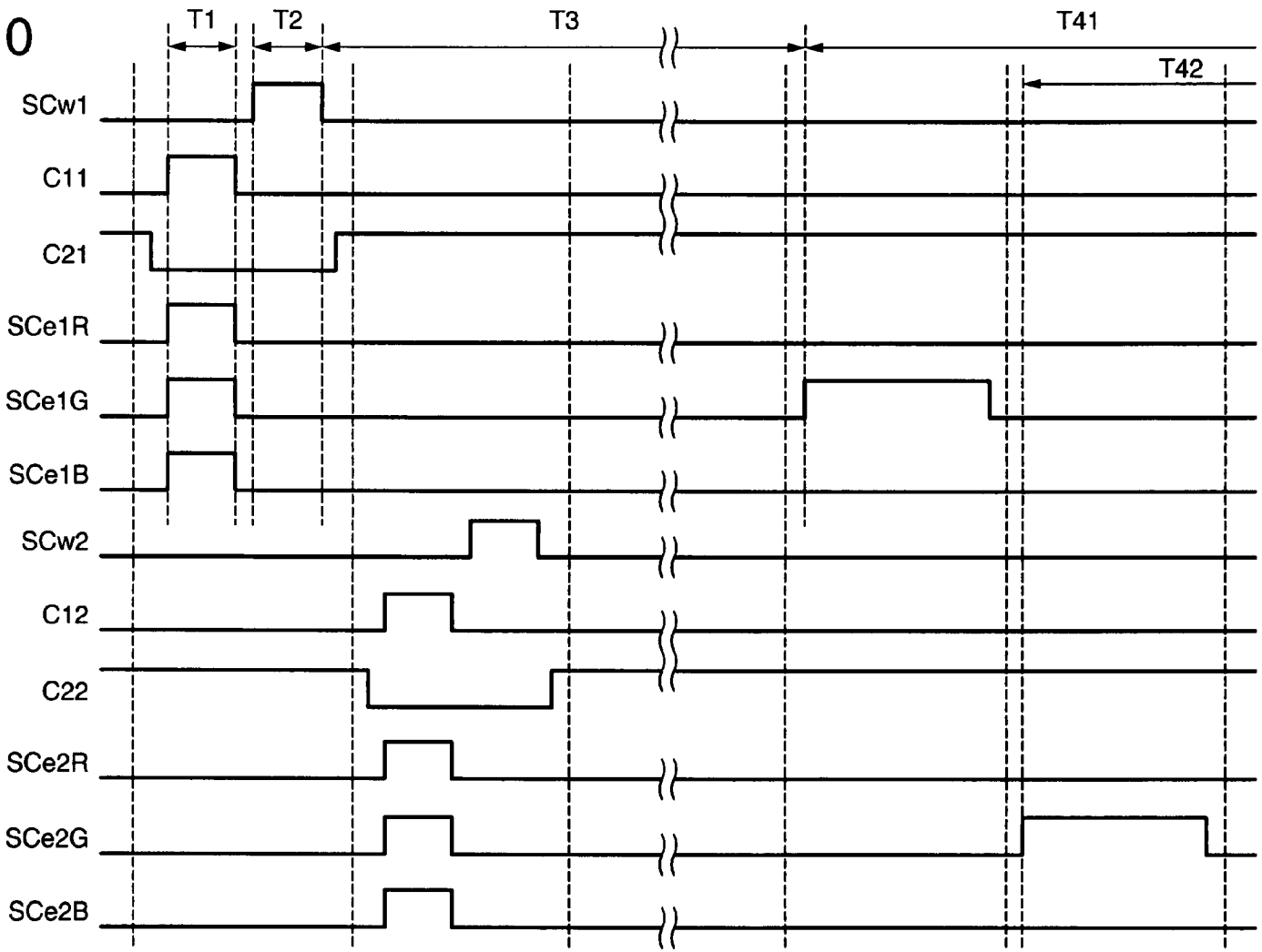
FIG. 10 is a timing chart illustrating signals output from a peripheral drive device 2 to a display panel unit 3 in the second embodiment of the invention.

FIG. 10 is a timing chart illustrating signals output from the peripheral drive device 2 to the display panel unit 3 in the second embodiment of the invention. As shown in FIG. 10, in the embodiment, the threshold storage period T1 and write period T2 are provided prior to the light emission period T3 in which the organic EL elements 25R, 25G, and 25B emit light, for activating each of the write scan lines YW1 to YWn. In addition, after the light emission period T3, the erase period T4 (T41, T42, . . . ) is provided in which the organic EL elements 25R, 25G, and 25B are in the non-light emission state (are erased).

First, in the storage period T1, the following signals are set to respective lines as follows: the write scan signal SCw1 is set to the logic level L to the write scan line YW1; the control signal C11 is set to the logic level H to the control line L11; the control signal C21 is set to the logic level L to the control line L21; and each of the erase scan signals SCe1R, SCe1G, and SCe1B is set to the logic level H to respective erase scan lines YE1R, YE1G, and YE1B. The control signal C21 having the logic level L turns off the transistor 63 shown in FIG. 9, resulting in light being not emitted from the organic EL elements 25R, 25G, and 25B.

The control signal C11 having the logic level H to the control line L11 turns on the transistor 62 shown in FIG. 9, resulting in the gate electrode and drain electrode of the drive TFT 23 being conducted. In addition, each of the erase scan signals SCe1R, SCe1G, and SCe1B having the logic level H to respective erase scan lines YE1R, YE1G, and YE1B results in the connection point in each of the pixels 20R, 20G, and 20B being the same potential as that of the power supply line Le. Accordingly, the storage capacitor 61 is connected between the gate electrode and source electrode of the drive TFT 23, resulting in a threshold voltage to turn on the drive TFT 23 being stored (held) in the storage capacitor 61.

After the storage period T1, in the write period T2, the following signals are set to respective lines as follows: only the write scan signal SCw1 is set to the logic level H to the write scan line YW1; the control signal C11 is set to the logic level L to the control line L11; the control signal C21 is set to the logic level L to the control line L21; and each of the erase scan signals SCe1R, SCe1G, and SCe1B is set to the logic level L to respective erase scan lines YE1R, YE1G, and YE1B. Accordingly, the switching TFT 21 provided in the pixel 20 (20R, 20G, and 20B) connected to the write scan line YW1 is turned on, resulting in each potential of the analog image signals VAR, VAG, and VAB via the respective data limes X1 to X3*m* being held into the storage capacitor 22 of respective pixels 20R, 20G, and 20B.

After the storage period T2, in the light emission period T3, the following signals are set to respective lines as follows: only the control signal C21 is set to the logic level H to the control line L21; the write scan signal SCw1 is set to the logic level L to the write scan line YW1; the control signal C11 is set to the logic level L to the control line L11; and each of the erase scan signals SCe1R, SCe1G, and SCe1B is set to the logic level L to respective erase scan lines YE1R, YE1G, and YE1B. Consequently, each transistor 63 is turned on. The current depending on the potential of the gate electrode of each drive TFT 23 flows via the channel of each drive TFT 23, flowing to respective organic EL elements 25R, 25G, and 25G via each transistor 63. As a result, the light emission luminance of each of the organic EL elements 25R, 25G, and 25B is achieved depending on the amount of current flow in each of the organic EL elements 25R, 25G, and 25B. In this regard, each of the organic EL elements 25R, 25G, 25B emits light at the same timing.

Here, the potential of the gate electrode of each drive TFT 23 is the summation of the potential held in each storage capacitor 22 and the potential stored (held) in each storage capacitance 61. The potential stored (held) in each storage capacitor 61 compensates the variation in the threshold voltage of each drive TFT 23 even if the variation is present. As a result, the light emission luminance depending on each of the analog image signals VAR, VAG, and VAB is achieved from respective organic EL elements 25R, 25G, and 25B.

In the erase period T4 (T41), after the light emitting period T3, the following signals are set to respective lines as follows: the write scan signal SCw1 is set to the logic level L to the write scan line YW1; the control signal C11 is set to the logic level L to the control line L11; the control signal C21 is set to the logic level H to the control line L21; and only the erase scan signal SCe1G is set to the logic level H to the erase scan line YE1G among the erase signals SCe1R, SCe1G, and SCe1B to the erase scan lines YE1R, YE1G, and YE1B. Consequently, the erase scan line YE1G is activated, resulting in the organic EL element 25G provided in the pixel 20 connected to the erase scan line YE1G being the non-light emission state (erased).

A case is described as above, in which the write scan line YW1 is activated. Each of the cases in which the write scan lines YW2 to YWn are activated is also carried out as follows: first, the threshold voltage of the drive TFT 23 is stored (held) in the threshold storage period T1; then, the potential of each of the analog image signals VAR, VAG, and VAB is stored in respective pixels 20R, 20G, and 20B; each of the organic EL elements 25R, 25G, and 25B each of which is provided in respective pixels 20R, 20G, and 20B emits light in the light emitting period T3; and the organic EL elements 25R, 25G, and 25B are the non-light emission state (erased) in the erase period T4.

Figure 11:
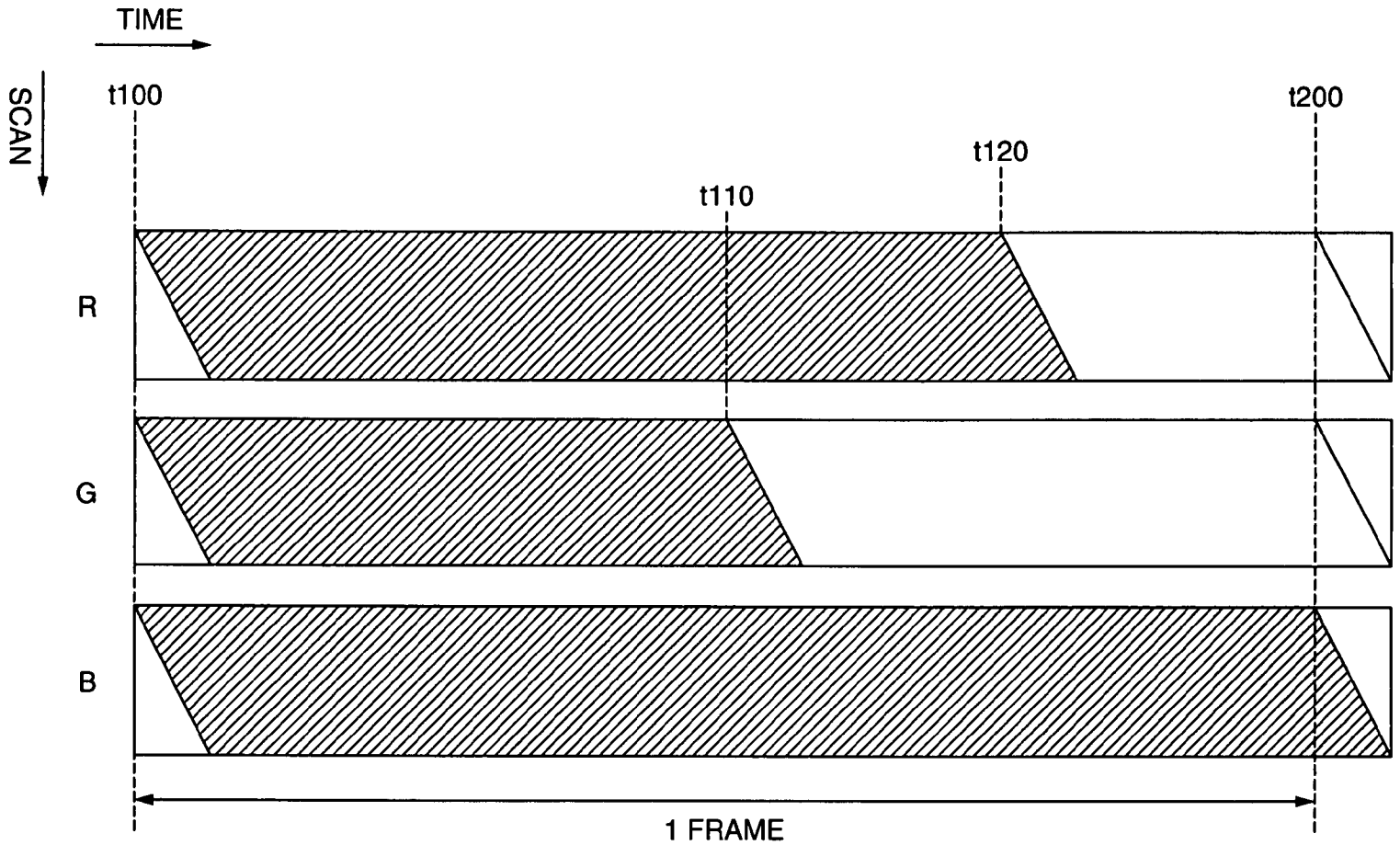
FIG. 11 is a diagram for explaining a driving method according to the second embodiment of the invention.

FIG. 11 is a diagram for explaining a driving method according to the second embodiment of the invention. As shown in FIG. 11, in the embodiment, the write scan line YW1 is selected at the time t100. Then, the organic EL elements 25R, 25G, and 25B provided in the pixel 20 connected to the write scan line YW1 start emitting light at the same timing. In this regard, prior to the organic EL elements 25R, 25G, and 25B start emitting light, the threshold voltage of the drive TFT 23 is stored (held) in the threshold storage period T1, and then the potential of each of the analog image signals VAR, VAG, and VAB is stored in respective pixels 20R, 20G, and 20B in the write period T2.

Subsequently, the write scan line YW2 is selected. Then, the organic EL elements 25R, 25G, and 25B provided in the pixel 20 connected to the write scan line YW2 start emitting light at the same timing. Likewise, the write scan lines YW3 to YWn are sequentially selected so that the organic EL elements 25R, 25G, and 25B provided in the pixel 20 connected to each of the write scan lines YW3 to YWn start emitting light at the same timing. In each of the cases in which the write scan lines YW2 to YWn are activated, also, prior to the organic EL elements 25R, 25G, and 25B start emitting light, the threshold voltage of the drive TFT 23 is stored (held) in the threshold storage period T1, and then the potential of each of the analog image signals VAR, VAG, and VAB is stored in respective pixels 20R, 20G, and 20B in the write period T2.

At the time t110, after a predetermined period from the time t100, during the scanning of the write scan lines YW3 to YWn, the scan driver start pulse SPYGE for erasing green is output to the erase scan driver 13 from the timing controller 8 in the peripheral drive device 2 with the erase scan driver clock signal CLYE and inverted erase scan driver clock signal XCLYE. Upon completion of the output of these signals, the erase scan line YE1G is selected at the time t110 in FIG. 11, resulting in the organic EL element 25G provided in the pixel 20 connected to the erase scan line YE1G being the non-light emission state (erased). This period is the erase period T41 described above. Subsequently, the erase scan line YE2G is selected, resulting in the organic EL element 25G provided in the pixel 20 connected to the erase scan line YE2G being the non-light emission state (erased). This period is the erase period T42 shown in FIG. 10. Likewise, the erase scan lines YE3G to YEnG are sequentially selected, sequentially resulting in the organic EL element 25G provided in the pixel 20 connected to each of the erase scan lines YE3G to YEnG being the non-light emission state (erased).

At the time t120, after a predetermined period from the time t100, during the scanning of the write scan lines YW3 to YWn, the scan driver start pulse SPYRE for erasing red is output to the erase scan driver 13 from the timing controller 8 in the peripheral drive device 2 with the erase scan driver clock signal CLYE and inverted erase scan driver clock signal XCLYE. Upon completion of the output of these signals, the erase scan line YE1R is selected at the time t120 in FIG. 11, resulting in the organic EL element 25R provided in the pixel 20 connected to the erase scan line YE1R being the non-light emission state (erased). Subsequently, the erase scan line YE2R is selected, resulting in the organic EL element 25R provided in the pixel 20 connected to the erase scan line YE2R being the non-light emission state (erased). Likewise, the erase scan lines YE3R to YEnR are sequentially selected, sequentially resulting in the organic EL element 25R provided in the pixel 20 connected to each of the erase scan lines YE3R to YEnR being the non-light emission state (erased).

Here, at the time, after a predetermined period from the time t100, during the scanning of the write scan lines YW3 to YWn, the scan driver start pulse SPYBE for erasing blue can be output to the erase scan driver 13 from the timing controller 8 in the peripheral drive device 2 with the erase scan driver clock signal CLYE and inverted erase scan driver clock signal XCLYE. As a result, the organic EL elements 25B provided in the pixels 20 connected to the erase scan lines YE1B to YEnB can be the non-light emission state (erased). However, in the embodiment, in the same manner of the first embodiment, the light emitting time of the organic EL element 25B is set as the same as the period of each sub-frame. Thus, no control carried out to render the organic EL element 25 B to be the non-light emission state (erased).

Upon completion of scanning one frame, in which the write scan lines YW1 to YWn have been scanned, the scan proceeds to the next frame. In an example shown in FIG. 11, the light emitting time of the organic EL elements 25R, 25G, and 25B are set in ratio of 0.75:0.5:1 in the same manner of the first embodiment. In the embodiment, each light emitting time of the organic EL elements 25R, 25G, and 25B is also determined by the luminance ratio obtained from the chromatic coordinate and the light emitting efficiency of each of the organic EL elements 25R, 25G, and 25B, the current to achieve the luminance ratio, and the current-voltage characteristic (I-V characteristic) of each of the organic EL elements 25R, 25G, and 25B. The light emitting ratio among the organic EL elements 25R, 25G, and 25B is preferably adjusted so that a predetermined white balance is achieved.

As described above, in the embodiment, the light emitting time of the organic EL elements 25R, 25G, and 25B is also adjusted by adjusting the timing for scanning the erase scan lines YE1R to YEnR, YE1G to YEnG, and YE1B to YEnB. As a result, the luminance ratio among red, green, and blue light is adjusted. Consequently, red, green, and blue light can be set as a predetermined luminance ratio even if the organic EL elements 25R, 25G, and 25B differ in characteristics.

In general, if the drive TFT 23 provided in each of the pixels 20R, 20G, and 20B has a variation in characteristics (e.g. threshold voltage), the light emission luminance depending on the analog image signals VAR, VAG, and VAB is not achieved in a case where the analog image signals VAR, VAG, and VAB are used. However, in the embodiment, the variation in characteristics of the drive TFT 23 is eliminated since the storage capacitor 61 is provided that stores (holds) the threshold voltage of the drive TFT 23. As a result, the light emission luminance can be achieved depending on the analog image signals VAR, VAG, and VAB as well as the variation in the white balance can be eliminated.

In both the first and second embodiments, the light emitting time of the organic EL elements 25R, 25G, and 25B can arbitrarily be adjusted by adjusting the output timing of the scan driver start pulse SPYRE for erasing red, scan driver start pulse SPYGE for erasing green, and scan driver start pulse SPYBE for erasing blue that are output to the erase scan driver 13 from the peripheral drive device 2. Because of this, the light emitting time of the organic EL elements 25R, 25G, and 25B may be adjusted, for example, based on results detected from a luminance sensor, which is provided for monitoring the luminance of light emitted from each of the pixels 20R, 20G, and 20B that are provided at a part of the display panel 11. Alternatively, the light emitting time of the organic EL elements 25R, 25G, and 25B may be adjusted by referring a table and a timekeeping result of a timer. The table is made by obtaining a luminance change with time of each of the organic EL elements 25R, 25G, and 25B. The timer is provided to the peripheral drive device 2 so as to measure operating time (accumulated light emitting time) of the organic EL device 1. They are compensatory devices, which can compensate the change with time in the white balance.

While in the above-mentioned embodiments, the organic EL elements 25R, 25G, and 25B are embodied as an electro-optical element, but the invention may be embodied as an inorganic electroluminescenct element. Put simply, the invention may be applied to an inorganic electroluminescent display device including the inorganic electroluminescent element. In the above-mentioned embodiments, examples in which the organic EL element is used are explained. However, the invention is not limited to these, liquid crystal elements, digital micro mirror devices (DMDs), field emission displays (FEDs), surface conductive electron-emitter displays (SEDs) or the like can be applicable.

Electronic Apparatus

Figure 12A:
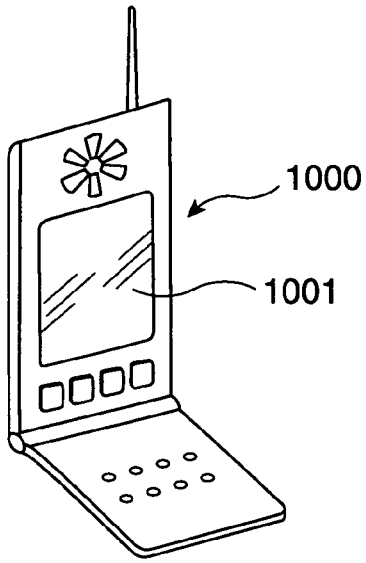
FIG. 12 is a diagram illustrating examples of an electronic apparatus according to a third embodiment of the invention.
Figure 12B:
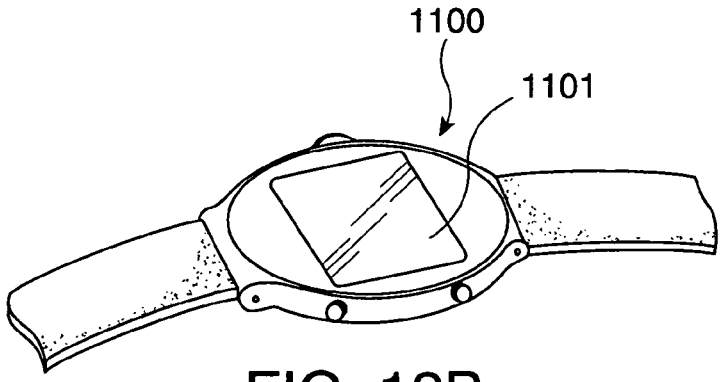
Figure 12C:
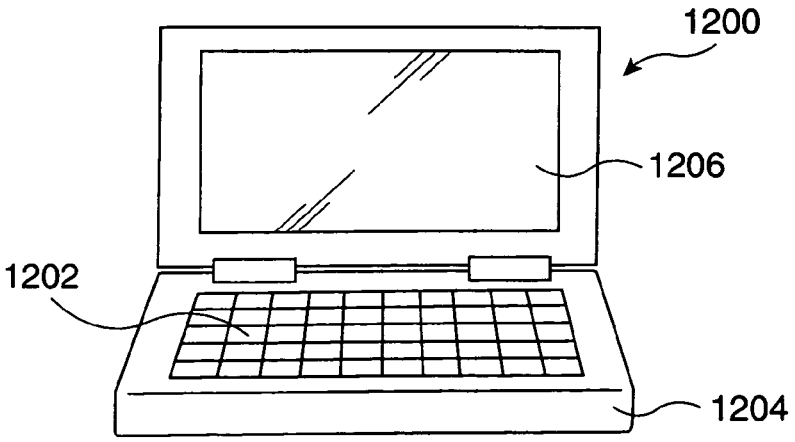

Next, an electronic apparatus according to the invention will be described. The electronic apparatus according to the invention is equipped with the organic EL device 1 described above as a display. Specifically, examples are shown in FIG. 12. FIGS. 12A through 12C are diagrams illustrating examples of the electronic apparatus according to the invention. FIG. 12A is a perspective view illustrating an example of cellular phones. In FIG. 12A, a cellular phone 1000 is equipped with a display 1001 using the organic EL device 1. FIG. 12B is a perspective view illustrating an example of wristwatch type electronic apparatuses. In FIG. 12B, a wristwatch 1100 is equipped with a display 1101 using the organic EL device 1. FIG. 12C is a perspective view illustrating an example of portable information processors such as word processors and personal computers. In FIG. 12C, an information processor 1200 is equipped with an input part 1202 such as a key board, a display 1206 using the organic EL device 1, and an information processor body (chassis) 1204. In each electronic apparatus illustrated in respective FIGS. 12 A through 12C, the service life of the light emitting element of the organic EL device included in the display is prolonged since each electronic apparatus is equipped with respective displays 1001, 1101, and 1206.

The organic EL device 1 of the embodiments can be applied to various electronic apparatuses such as portable information terminals such as viewers or game machines, electronic books, electronic paper, or the like in addition to the above-described electronic apparatuses. In addition, the organic EL display device 1 can be applied to various electronic apparatuses such as video cameras, digital cameras, car navigations, mobile stereos, operation panels, personal computers, printers, scanners, televisions, video players, or the like.

What is claimed is:

1. An organic electroluminescent device, comprising:

a plurality of pixels comprising:

a red light emitting element to emit red light;

a green light emitting element to emit green light;

a blue light emitting element to emit blue light;

a drive element driving each of the red light emitting element, the green light emitting element, and the blue light emitting element based on a signal from a plurality of write scan lines and a signal from a plurality of data lines; and a capacitor storing a characteristic of the drive element;

a drive device adjusting a luminance ratio among the red light, the green light, and the blue light by adjusting light emitting time of each of the red light emitting element, the green light emitting element, and the blue light emitting element;

a first control line directly connected to a first transistor that controls whether the characteristic of the drive element is stored in the capacitor, the first control line being provided parallel to the plurality of write scan lines;

a second control line directly connected to a second transistor that controls whether each of the red light emitting element, the green light emitting element, and the blue light emitting element is driven or not by using the drive element having a characteristic compensated based on a content stored in the capacitor, the second control line being provided parallel to the plurality of write scan lines, a drain of the first transistor being directly connected to the source of the second transistor and the drain of the second transistor being directly connected to a corresponding one of the red light emitting element, the green light emitting element, and the blue light emitting element; and a first electrode of the capacitor being directly connected to a third transistor, a fourth transistor, a second electrode of an additional capacitor, and a second electrode of the capacitor, the second electrode of capacitor being directly connected to a gate electrode of a fifth transistor.

2. The organic electroluminescent device according to claim 1, the drive device adjusting the luminance ratio among the red light, the green light, and the blue light so as to achieve a predetermined white balance.

3. The organic electroluminescent device according to claim 1, wherein the drive device renders each of the red light emitting element, the green light emitting element, and the blue light emitting element to emit light at an identical light emission start timing, and individually sets a non-light emission start timing to render each of the red light emitting element, the green light emitting element, and the blue light emitting element to be a non-light emission state so as to adjust the luminance ratio among the red light, the green light, and the blue light.

4. The organic electroluminescent device according to claim 3 further comprising:

the plurality of write scan lines being provided for a unit composed of a predetermined number of pixels among the plurality of pixels;

a plurality of erase scan lines, each being provided to each of the red light emitting element, the green light emitting element, and the blue light emitting element that are included in each of the predetermined number of pixels, and the plurality of erase scan lines being provided corresponding to the plurality of write scan lines; and the plurality of data lines each being provided to each of the red light emitting element, the green light emitting element, and the blue light emitting element that are included in each of the predetermined number of and extending in a direction perpendicular to the plurality of write scan lines and the plurality of erase scan lines;

wherein the drive device renders each of the red light emitting element, the green light emitting element, and the blue light emitting element that are provided in each of the predetermined number of pixels to emit light via the plurality of write scan lines, and renders each of the red light emitting element, the green light emitting element, and the blue light emitting element that are provided in each of the predetermined number of pixels to be the non-light emission state via the plurality of erase scan lines.

5. The organic electroluminescent device according to claim 4, wherein the drive device divides one frame into a plurality of sub-frames depending on the number of gray-scales represented by an image signal supplied to the plurality of data lines, and controls one of a light emission state and the non-light emission state of each of the red light emitting element, the green light emitting element, and the blue light emitting element in each of the plurality of sub-frames.

6. The organic electroluminescent device according to claim 5, the drive device controlling the light emitting time of each of the red light emitting element, the green light emitting element, and the blue light emitting element in the plurality of sub-frames so as to be a predetermined time ratio.

7. The organic electroluminescent device according to claim 1, wherein the drive device compensates a luminance change with time of each of the red light emitted from the red light emitting element, the green light emitted from the green light emitting element, and the blue light emitted from the blue light emitting element.

8. An electronic apparatus, comprising the organic electroluminescent device according to claim 1.

9. The organic electroluminescent device according to claim 1, the first control line being connected to a single transistor as the first transistor for each of the red light emitting element, the green light emitting element, and the blue light emitting element.

* * * * *